US006018972A

United States Patent [19]

Irie

[11] Patent Number: 6,018,972

[45] Date of Patent: Feb. 1, 2000

[54] METHOD AND APPARATUS FOR FORMING AN END PORTION OF A CYLINDRICAL MEMBER

[75] Inventor: Tohru Irie, Nagoya, Japan

[73] Assignee: Sango Co., Ltd, Nagoya City, Japan

[21] Appl. No.: 09/187,045

[22] Filed: Nov. 6, 1998

[30] Foreign Application Priority Data

Nov. 11, 1997 [JP] Japan ..... 9-308240
Sep. 15, 1998 [JP] Japan ..... 10-279459

[51] Int. Cl.[7] ..... B21D 41/04

[52] U.S. Cl. ..... 72/121; 72/120

[58] Field of Search ..... 72/78, 82, 120, 72/121, 370.1, 370.12

[56] References Cited

U.S. PATENT DOCUMENTS 1,500,261 7/1924 Page .
4,563,887 1/1986 Bressan et al. .

FOREIGN PATENT DOCUMENTS 3-226327 10/1991 Japan .
B2-2534530 6/1996 Japan .

OTHER PUBLICATIONS

V.G. Sereda et al., *Calculation of the Energy and Force Parameters in Planetary Rolling of Tubular Blanks*, Kuznechnoshtampovochnoe proizvodstvo, 1989, (5), pp. 2–4.

Matthew, P., "Eccentric Metal Spinning–A New Method to Produce Multi–Recessed Parts" Metallurgia and Metal Forming, Dec. 1974, pp. 378–379.

*Primary Examiner*—Lowell A. Larson
*Attorney, Agent, or Firm*—Oliff & Berridge, PLC

[57] ABSTRACT

The present invention is directed to a method and apparatus for forming an end portion of a cylindrical member or cylinder. A main shaft is positioned on a plane including the central axis of the cylinder, in parallel therewith. At least one roller is supported on the main shaft to be radially moved to and from the main shaft. The cylinder is held to position the central axis thereof in parallel with the main shaft. Then, at least one of the cylinder and the roller is moved relative to each other, with the central axis of the cylinder held in parallel with the main shaft, while the roller is moved radially toward an eccentric axis offset from the central axis of the cylinder, with the roller being in substantial contact with the outer surface of the one end portion of the cylinder. And, at least one of the cylinder and the roller is driven to be rotated relative to each other about the eccentric axis of the cylinder. As a result, a reduced diameter portion such as a tapered portion having the eccentric axis is formed on the one end portion of the cylinder.

16 Claims, 18 Drawing Sheets

METHOD AND APPARATUS FOR FORMING AN END PORTION OF A CYLINDRICAL MEMBER

BACKGROUND OF THE INVENTION

1. Field of the Invention

The present invention relates to a method for forming an end portion of a cylindrical member such as a metal cylinder or shell, and an apparatus therefor, especially the method and apparatus for forming the end portion of the cylindrical metal member by spinning to form a reduced diameter portion having an eccentric or offset axis on the end portion of the cylindrical member.

2. Description of the Related Arts

In Japanese Patent Laid-open Publication No.3-226327, disclosed is a method for forming an end portion of a cylindrical member (hereinafter, simply referred to as a cylinder) made of metal to form a reduced diameter portion on the end portion. According to the Publication, a spinning process is performed by supporting the cylinder with a chuck and rotating it about its axis, and moving a roller for forming toward the axis to reduce the diameter of the cylinder, thereby to form the reduced diameter portion having a neck portion and a tapered portion. In general, the spinning process is employed to form a plate into a shell. Likewise, a flange and neck portion can be formed by spin flow forming into a cylindrical can body, as disclosed in U.S. Pat. No. 4,563,887. Furthermore, a computerized spinning machine has been proposed in Japanese Patent No. 2,534,530.

Recently, it has been requested to form the reduced diameter portion on the end portion of the cylinder to be offset or eccentric to a main body of the cylinder. When the metal cylinder is used for an outer shell of a muffler of an automotive vehicle, for example, it has been requested to form the reduced diameter portion having an eccentric axis on the end portion of the shell. Also, when the metal cylinder is used for a housing of a catalytic converter, it has been requested to form the reduced diameter portion having the eccentric axis on the end portion of the housing, so as to locate the converter near an engine.

According to the prior methods for forming the cylinder or shell by the spinning process, the reduced diameter portion was formed to be coaxial with the main body of the cylinder, but the reduced diameter portion having the eccentric axis could not be formed on the end portion of the cylinder. In order to produce the cylinder like the shell or housing as described above, therefore, the portions corresponding to the main body and the reduced diameter portion were formed by press working, and then these components were connected together by welding or the like. According to these methods, however, the produced cylinder can not be expected to be so strong, comparing with that of the integral construction. Furthermore, they need the connecting process, different from the forming process, so that it is difficult to produce the cylinder by those methods, and it is almost impossible to produce the cylinder by the computerized forming process as described in the prior publication. As a result, the manufacturing cost of the cylinder shall be increased, comparing with the cylinder of the coaxial type formed by the spinning process.

SUMMARY OF THE INVENTION

Accordingly, it is an object of the present invention to provide a method for forming a reduced diameter portion having an eccentric axis on an end portion of a cylindrical member or cylinder, easily and properly, by a spinning process.

It is another object of the present invention to provide an apparatus for forming a reduced diameter portion having an eccentric axis on an end portion of a cylinder, easily and properly, by a spinning process.

In accomplishing the above and other objects, the method for forming an end portion of a cylinder by spinning, comprises the steps of (1) supporting at least one roller to be radially moved to and from a main shaft, (2) holding the cylinder to position the central axis thereof in parallel with the main shaft, and (3) driving at least one of the cylinder and the roller to be rotated relative to each other about an eccentric axis offset from the central axis of the cylinder, with the roller radially moved to be in contact with the outer side of one end portion of the cylinder, to form a reduced diameter portion on the one end portion of the cylinder.

The driving step may include the step of moving at least one roller radially in accordance with a plurality of spinning cycles.

The method for forming an end portion of a cylinder by spinning, may comprise the steps of (1) positioning a main shaft on a plane including the central axis of the cylinder, in parallel therewith, (2) supporting at least one roller on the main shaft to be radially moved to and from the main shaft, (3) holding the cylinder to position the central axis thereof in parallel with the main shaft, (4) moving at least one of the cylinder and the roller relative to each other, with the central axis of the cylinder held in parallel with the main shaft, (5) moving the roller radially toward an eccentric axis offset from the central axis of the cylinder, with the roller being in substantial contact with the outer surface of the one end portion of the cylinder, and (6) rotating at least one of the cylinder and the roller to be rotated relative to each other, to form a reduced diameter portion on the one end portion of the cylinder.

The driving step may include the step of moving at least one of the cylinder and the roller relative to each other, to move the central axis of the cylinder and the eccentric axis thereof gradually close to each other, in accordance with a plurality of cycles repeated during the rotating operation of at least one of the cylinder and the roller.

At least one of the cylinder and the roller may be adapted to be rotated relative to each other, to trace a predetermined position where a distance from the outer surface of the cylinder to the eccentric axis thereof is constant, every cycle of the rotating operation of at least one of the cylinder and the roller. When a difference between the outer diameter of the cylinder and a desired outer diameter of the reduced diameter portion of the cylinder to be formed exceeds a predetermined forming limit, the cylinder and the roller may be rotated about the same axis as the central axis of the cylindrical member, until the difference will become smaller than the predetermined forming limit.

The apparatus for forming the end portion of the cylinder by spinning includes devices for performing the steps as described above. For example, the apparatus includes a main shaft positioned on a plane including the central axis of the cylinder, in parallel therewith, and at least one roller mounted on the main shaft to be radially movable to and from the main shaft, and in contact with the end portion of the cylinder. The apparatus further includes a first driving device for moving at least one of the cylinder and at least one roller relative to each other, in parallel with the central axis of the cylinder and the main shaft, a second driving device for moving at least one roller radially toward an eccentric axis offset from the central axis of the cylinder, with at least one roller being in substantial contact with the outer surface of the one end portion of the cylinder, and rotating at least one roller about the main shaft relative to the cylinder, and a control device for controlling the first driving device and second driving device to form a reduced diameter portion on the one end portion of the cylinder.

The apparatus may further include a third driving device for moving at least one of the cylinder and at least one roller relative to each other, vertically to the plane including the central axis of the cylinder.

According to the method and apparatus as described above, the reduced diameter portion may be formed to provide a tapered portion, with the diameter of the cylinder gradually reduced from a main body thereof toward the tip end thereof. The reduced diameter portion may be formed to provide the tapered portion and a neck portion of a tubular configuration extending from the tip end of said tapered portion, with the central axis of the neck portion positioned in parallel with the central axis of the cylindrical member.

BRIEF DESCRIPTION OF THE DRAWINGS

The above stated object and following description will become readily apparent with reference to the accompanying drawings, wherein like reference numerals denote like elements, and in which.

DESCRIPTION OF THE PREFERRED EMBODIMENTS

Figure 1:
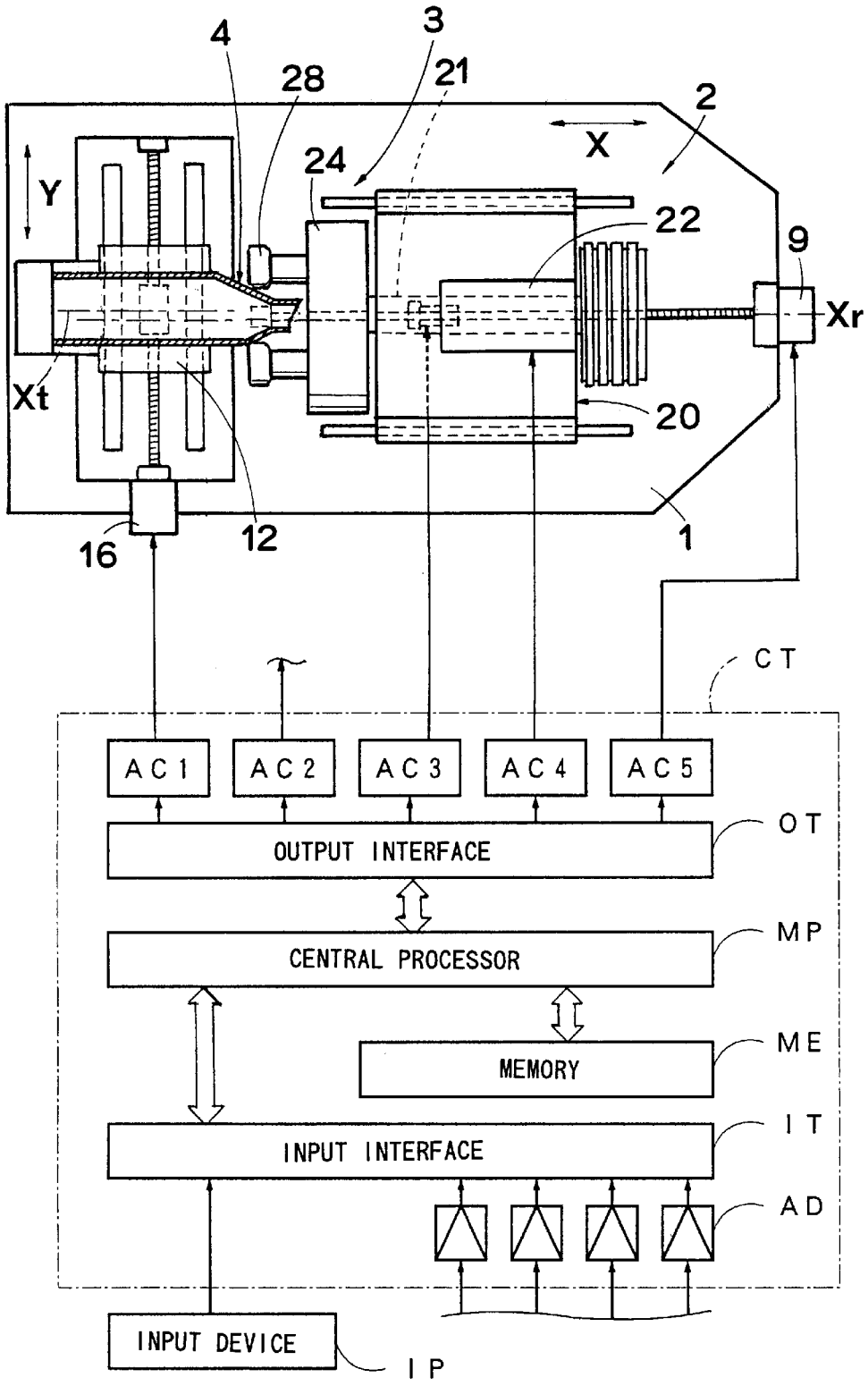
FIG. 1 is a schematic block diagram illustrating a spinning apparatus according to an embodiment of the present invention.
Figure 2:
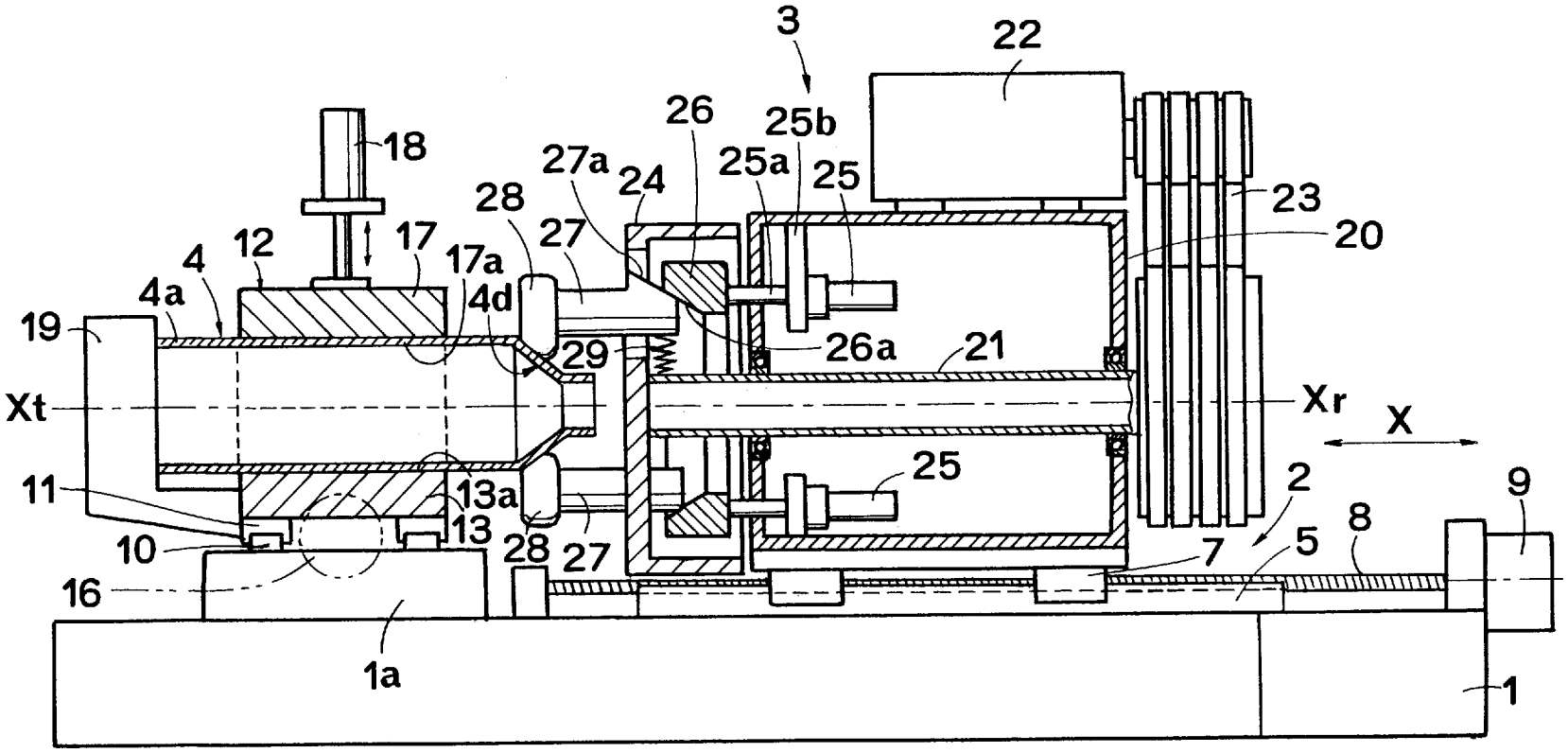
FIG. 2 is a side view of the spinning apparatus with a portion thereof sectioned according to the above embodiment of the present invention.
Figure 3:
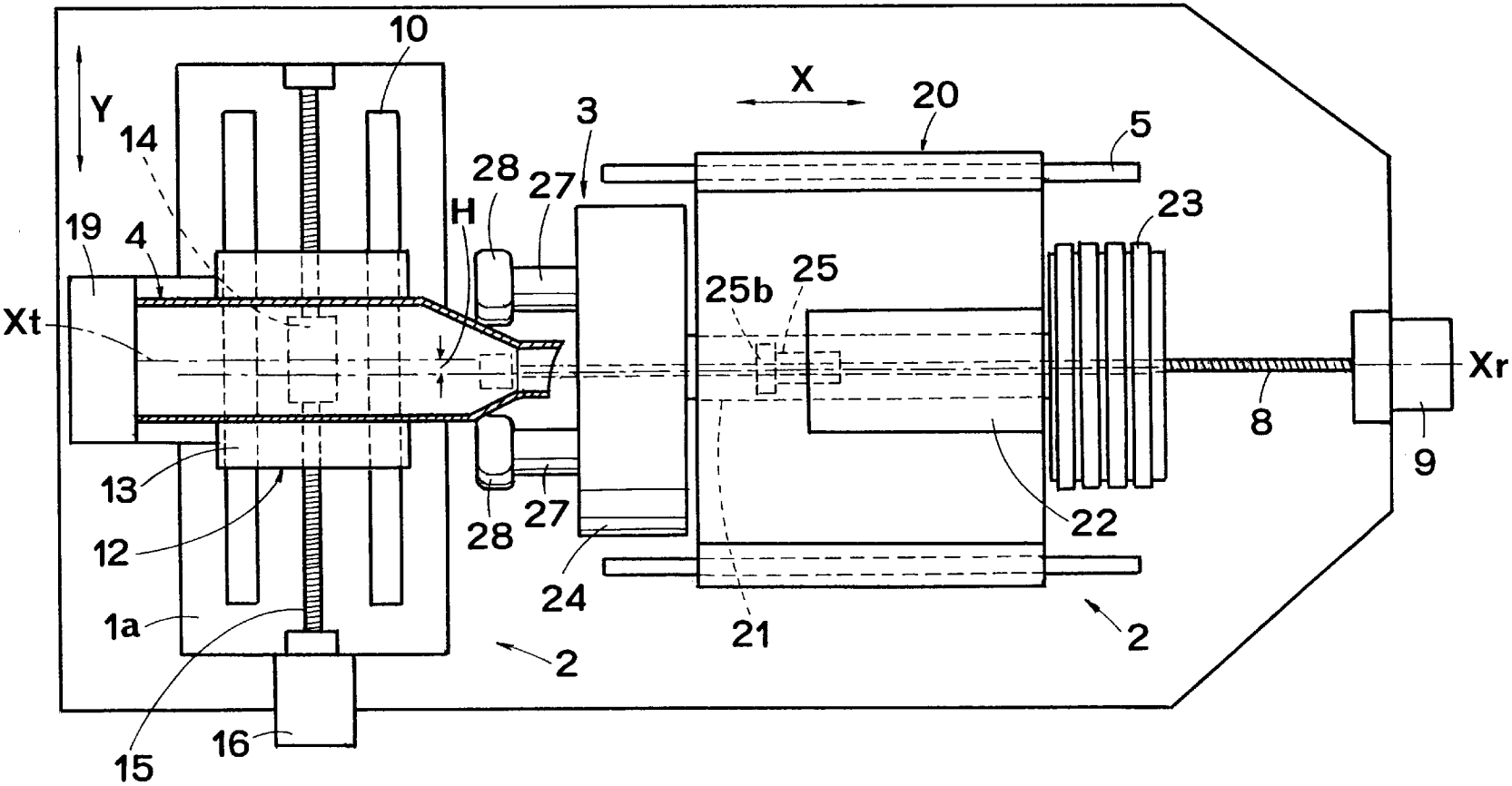
FIG. 3 is a plan view of the spinning apparatus with a portion thereof sectioned according to the above embodiment of the present invention.
Figure 5:
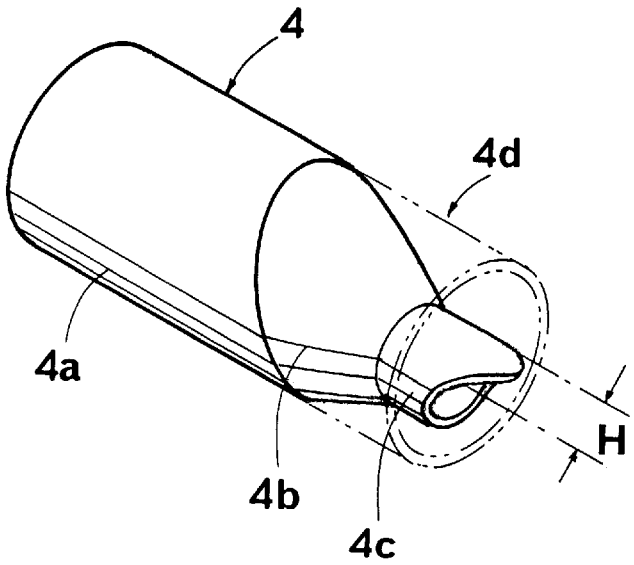
FIG. 5 is a perspective view showing a cylindrical member before and after being formed according to the above embodiment of the present invention.

Referring to FIGS. 1–3, there is schematically illustrated a spinning apparatus according to an embodiment of the present invention, which is adapted to configure an end portion of a cylindrical member (i.e., cylinder), as shown by a solid line in FIG. 5, to produce end products used for an outer shell (not shown) of a muffler for an automobile, a case (not shown) of a catalytic converter, or the like. The cylinder to be formed according to the present embodiment is the one made of stainless steel, while it is not limited to this, and may be selected from other metallic cylinders. In FIGS. 1–3, the spinning apparatus according to the present embodiment includes a first driving mechanism 2 that serves as the first driving means according to the present invention, and a second driving mechanism 3 that serves as the second driving means according to the present invention, both of which are mounted on a base 1.

In the first driving mechanism 2, a central axis Xt of a cylinder 4 is employed as X-axis, in parallel with which a pair of X-axis guide rails (represented by "5") are fixedly secured to one side (right side in FIGS. 2, 3) on the base 1. A case 20 is arranged to be movable along the X-axis guide rails 5. The case 20 has a ball socket 7 secured under its base, which is engaged with a spline shaft 8. This shaft 8 is mounted on the base 1 in parallel with the X-axis guide rails 5, to be rotated by a servo motor 9. Accordingly, when the spline shaft 8 is rotated by the servo motor 9, the case 20 is moved along the X-axis. On the other hand, a bed 1*a* is formed on the other side (left side in FIGS. 2, 3) of the base 1. Fixedly secured to the bed 1*a* are a pair of Y-axis guide rails (represented by "10"), on which a pair of sliders (represented by "11") for supporting a clamp device 12 are movably mounted, respectively. The clamp device 12 includes a lower clamp 13 supported by the sliders 11, and an upper clamp 17 arranged upward the lower clamp 13, to clamp the cylinder 4 between the lower clamp 13 and upper clamp 17. The lower clamp 13 has a ball socket 14 secured thereunder, which is engaged with a spline shaft 15. This shaft 15 is mounted on the case 20 in parallel with the Y-axis guide rails 10, to be rotated by a servo motor 16. When the spline shaft 15 is rotated by the servo motor 16, the clamp device 12 is moved along the Y-axis relative to the case 20.

Above the clamp device 12, an actuator 18, which is activated by oil pressure, for example, and which serves as a driving device, is arranged to support the upper clamp 17 and drive it vertically. When the cylinder 4 is set to or removed from the clamp device 12, the upper clamp 17 is lifted by the actuator 18 upward. A clamp face 13*a* of a half cylinder configuration is formed on the upper surface of the lower clamp 13, and a clamp face 17*a* of a half cylinder configuration is formed on the lower surface of the upper clamp 17. Therefore, when the cylinder 4 is clamped between the clamp faces 13*a* and 17*a*, it is secured not to be rotated or moved. On the clamp device 12, a stopper 19 is disposed at the opposite side to the case 20, to abut on a one end portion of the cylinder 4. The stopper 19 is secured to the lower clamp 13, so as to be movable together with the clamp device 12. If the stopper 19 is connected to the lower clamp 13 to be adjustable along the X-axis, positioning of the cylinder 4 in its axial direction can be made properly and easily. Accordingly, when the cylinder 4 is set on the clamp face 13*a* of the lower clamp 13, with the one end portion of the cylinder 4 abutted on the stopper 19, and then the upper clamp 17 is actuated to move downward by the actuator 18, the cylinder 4 is clamped at a predetermined position between the lower clamp 13 and upper clamp 17. In this case, the cylinder 4 is positioned such that its axis Xt is located on the same plane as the plane where the longitudinal central axis Xr of a main shaft 21, which will be described later, is located in parallel with the base 1, i.e., on the same height from the base 1 as the height of the axis Xr from the base 1.

With respect to the second driving mechanism 3, the main shaft 21 is positioned on the same plane as the plane, on which the axis Xt of the cylinder 4 is located, and which is parallel with the base 1. The main shaft 21 is placed opposite to the cylinder 4, and mounted on the case 20 to be rotated about its axis Xr by a motor 22, which serves as the rotating means, through a connecting belt 23. A rotary member 24 is secured to one end portion of the main shaft 21 opposite to the cylinder 4, so that the rotary member 24 is rotated about the axis Xr in accordance with the rotation of the main shaft 21 about the axis Xr. The rotary member 24 is formed into a cylindrical case with a bottom, at the center of which the main shaft 21 is secured to the rotary member 24. In the case 20, a pair of actuators (represented by "25") of a pressure cylinder actuated by oil, air or the like are received and mounted on the case 20 through brackets (represented by "25*b*"). Each actuator 25 has a rod 25*a* slidably received therein in parallel with the axis Xr of the main shaft 21, and moved back and forth in response to the pressurized oil or air fed into the actuator 25. A force transmitting member 26 of a circular ring plate configuration is secured to the tip ends of the rods 25*a*, and disposed within the rotary member 24 to be moved to and from the cylinder 4 in response to the sliding movement of the rods 25*a*. The transmitting member 26 has a tapered surface 26*a* formed on the inner surface of its open end portion, extending toward its tip end to enlarge its inner diameter gradually.

Figure 4:
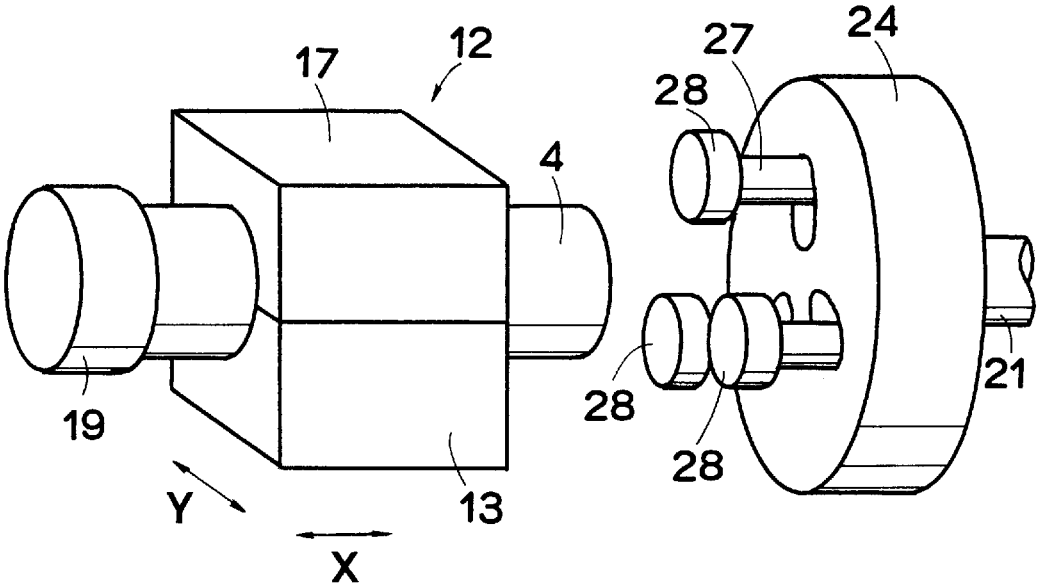
FIG. 4 is a perspective view showing a clamp section for clamping a cylindrical member and a roller section according to the above embodiment of the present invention.

As shown in FIGS. 2 and 4, a plurality of support members 27 (three support members in the present embodiment) are disposed around the periphery of the rotary member 24 with an even space defined between them, and mounted on the rotary member 24 to be movable in parallel with the main shaft 21, and movable in a radial direction from the central axis Xr of the main shaft 21. Each support member 27 has a tapered surface 27*a* formed on the inner side of the rotary member 24 to abut on the tapered surface 26*a* of the transmitting member 26. A roller 28 is mounted on the tip end of each support member 27 to be rotated about its axis. Also disposed in the rotary member 24 is a biasing device for urging each support member 27 toward the outer periphery of the rotary member 24, such as a compression spring 29 as shown in FIG. 2. Accordingly, when the transmitting member 26 is activated by the actuators 25 to move forward (leftward in FIG. 2), each support member 27 engaged with the transmitting member 26 through the tapered surfaces 26*a*, 27*a*, and each roller 28 mounted on the support member 27 are moved in a radial direction toward the axis Xr of the main shaft 21. Whereas, when the transmitting member 26 is retracted by the actuators 25 to move rearward (rightward in FIG. 2), each support member 27 and roller 28 are moved outwardly in a radial direction.

The roller 28 may be provided only one, but it is preferable to provide a plurality of rollers, so as to reduce intermittent impacts. The course traced by the roller 28 is not necessarily limited to a straight line in the radial direction, but any course may be selected as long as the roller 28 can be moved to and from the axis Xr of the main shaft 21. In stead of the actuator 25 of the pressure cylinder, other devices such as those of a screw type, lever type or the like may be employed as the device for actuating the roller 28. As a further embodiment of the device for actuating the roller 28 to be moved in a radial direction toward the axis Xr, may be employed a mechanism having a main shaft of dual tubes, which are connected to the roller 28 through differential gear units (e.g., planetary gear system, not shown herein), respectively, and wherein the rotation of the main shaft will produce a difference between the rotational speeds of the tubes, so as to cause the roller 28 to be moved in the radial direction.

The motors 9, 16, 22 and actuators 18, 25 are electrically connected to a controller CT as shown in FIG. 1, from which control signals are output to the actuators to control them numerically. The controller CT includes a central processor MP, memory ME, input interface IT and output interface OT, which are connected with each other through a bass bar, as shown in FIG. 1. The central processor MP is adapted to execute a program for spinning according to the present embodiment, and the memory ME is adapted to memorize the program and temporarily memorize variable data needed to execute the program. An input device IP is connected to the input interface IT to input initial conditions, operating conditions or the like of each actuator into the central processor MP, e.g., by operating a key board or the like manually. There are provided various sensors (not shown), if necessary, and signals detected by those sensors are fed to the controller CT, in which the signals are input from the input interface IT to the central processor MP through amplifying circuits AD or the like. The control signals are output from the output interface OT and fed into the motors 9, 16, 22 and actuators 18, 25, through driving circuits AC1 to AC5. In stead of the controller CT, a control circuit may be provided for each device to perform a predetermined individual control, respectively.

Figure 15:
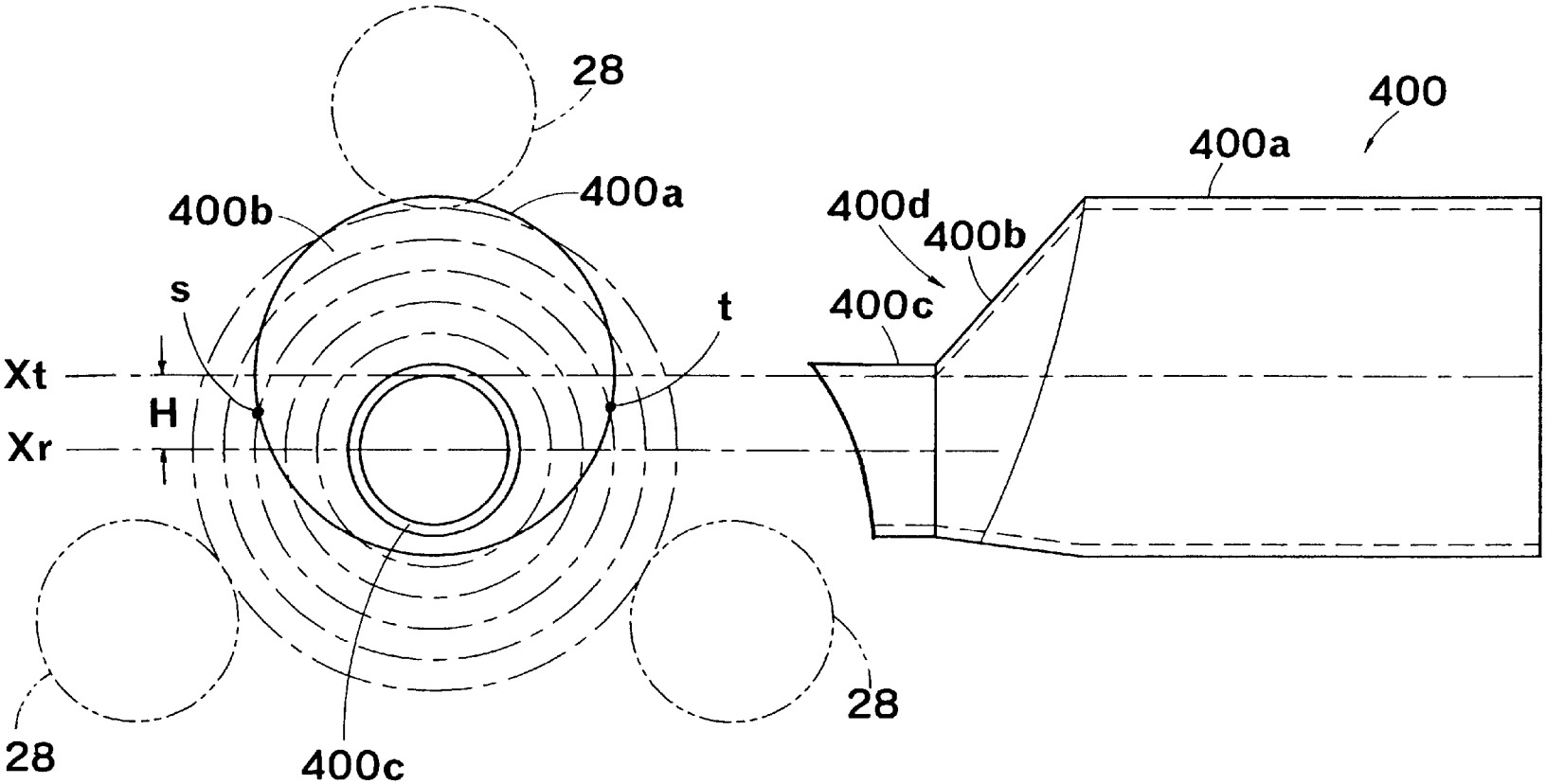
FIG. 15 is a diagram showing a concept for reducing the diameter of the end portion of the cylindrical member according to yet further embodiment of the present invention.

According to the spinning apparatus as constituted above, various methods can be contemplated for reducing the diameter of the end portion of the cylinder. The easiest method in those methods is a method for moving the cylinder (represented by "400" in this case) as shown in FIG. 15 to a position where the axis Xt of the cylinder 400 is placed to a position which is offset from the axis Xr of the main shaft 21 by an offset amount (H), driving the roller 28 to be rotated about the axis Xr, and moving the roller 28 in a radial direction toward the axis Xr. In order to perform the spinning process within the limit for reducing the diameter of the end portion of the cylinder, in this case, the spinning process shall be performed in accordance with a plurality of forming cycles, as shown by one-dot chain lines in FIG. 15. According to the method as shown in FIG. 15, however, the spinning process is not performed in such a condition that each roller 28 is always in contact with the cylinder 400, but the spinning process is performed in the condition that each roller 28 is in contact with the cylinder 400, intermittently. For example, according to the third forming process in FIG. 15, the roller 28 will contact with the cylinder 400 only at its circular arc portion above a line connecting positions "s" and "t" in FIG. 15. Therefore, the roller 28 will not contact with the lower portion of the cylinder 400, thereby to be rotated freely. In other words, about half of the locus traced by the roller 28 has not been used for the process, so that the forming efficiency will be low. In the case where the roller 28 is rotated clockwise in FIG. 15, when the roller 28 is shifted from its freely rotating condition to its forming condition, the roller 28 will abut on the cylinder 400 at the position "s", the impact will be applied to both of the cylinder 400 and the roller 28, to cause an intermittent vibration and noise. These are not so serious, provided that the offset amount is small. However, if the offset amount is needed to be large, they shall be avoided in terms of forming accuracy and maintenance of the apparatus. In the embodiments as described hereinafter, therefore, in order to avoid them, the spinning process is performed as follows.

Figure 6:
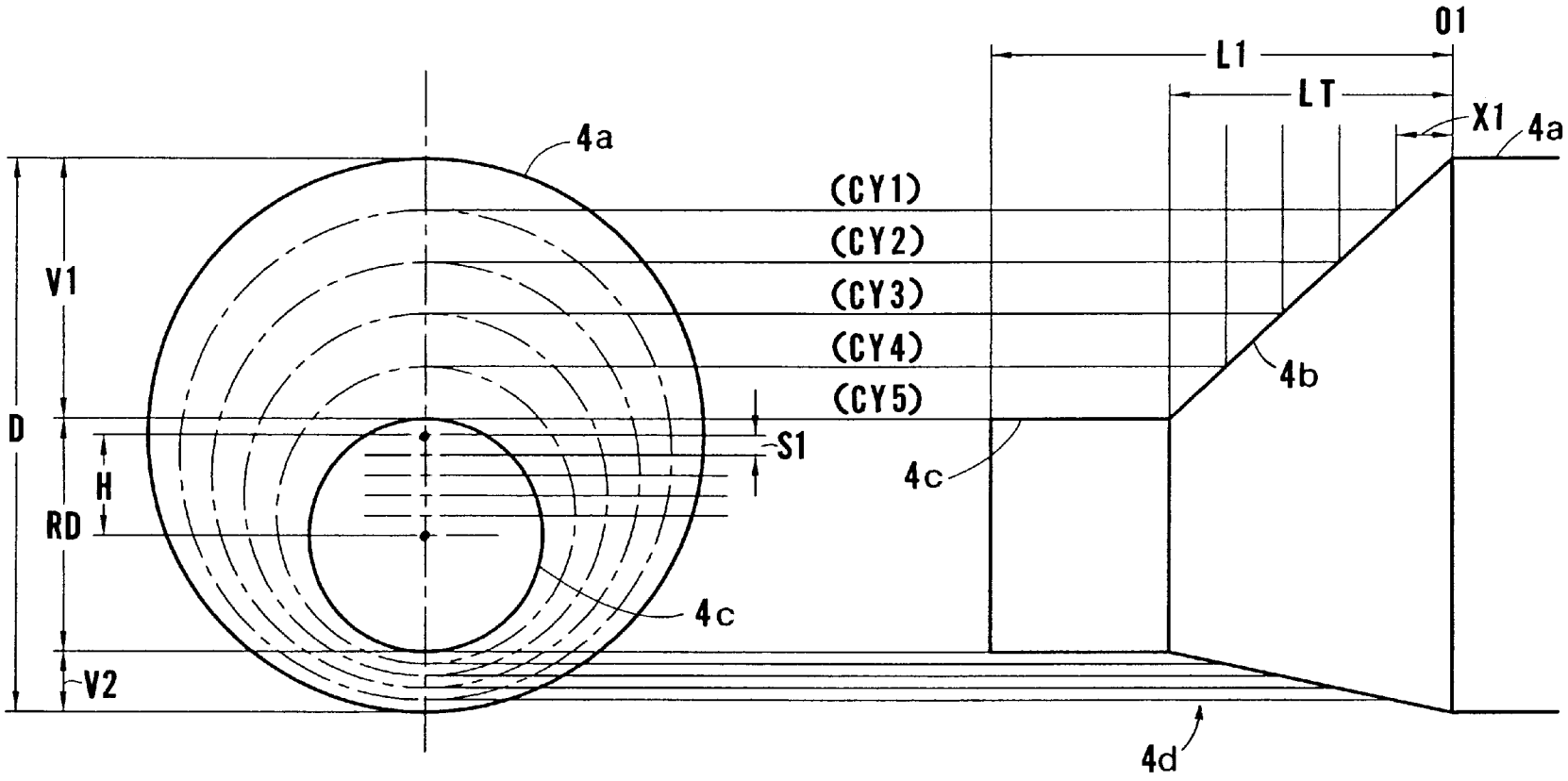
FIG. 6 is a diagram showing a basic concept for reducing the diameter of the end portion of the cylindrical member according to the above embodiment of the present invention.

Referring to FIG. 6, will be explained an embodiment of the method for reducing the diameter of the end portion of the cylinder by the above-described spinning apparatus. A thick solid line in FIG. 6 indicates an estimated configuration of the finished cylinder 4, which includes a main body 4*a*, and a tapered portion 4*b* and neck portion 4*c* which form the reduced diameter portion. At the outset, a starting position (O1) for starting the spinning process is set to a position retracted from the tip end of the cylinder 4 a forming distance (L1). When the tapered portion 4*b* is formed, the offset amount (H) is divided by a predetermined forming cycles (N) (N=5, according to the embodiment in FIG. 6), so that a moving distance toward the eccentric axis every cycle. i.e., moving distance (S1) along the Y-axis per one cycle, is set. In this embodiment, each moving distance (S1) is set to be equal, but a ratio for dividing the offset amount may be altered in accordance with the forming process to be required. For example, the moving distance between the cycles in an initial stage of the forming process may be made relatively long to reduce the forming time period, or the moving distance between the cycles in a terminating stage of the forming process may be made relatively short to improve the finished accuracy of the product. Likewise, with respect to the longitudinal length, a tapered length (LT) is divided by the predetermined forming cycles (N=5), so that a moving distance (X1) along the X-axis per one cycle, is set.

In FIG. 6, "D" indicates a diameter of the main body 4*a* of the cylinder 4, "RD" indicates the smallest diameter of the tapered portion 4*b* which is equal to the diameter of the neck portion 4*c*. "V1" indicates a reduced amount of the diameter of a portion to be formed to a large extent, and "V2" indicates a reduced amount of the diameter of a portion to be formed to a small extent. "CY1" to "CY5" indicate the cycle of the forming process. The number of forming cycles (N) is selected properly in view of the limit for reducing the diameter of the cylinder 4. According to the present embodiment, the moving distance per one cycle is set to a value which does not exceed the limit for reducing the diameter of the cylinder. The limit for reducing the diameter of the cylinder is the limit at which plastic deformation working of the cylinder can not be made appropriately due to a material characteristic of the cylinder. Therefore, if the process for reducing the diameter of the cylinder is made to exceed that limit, the thickness of the cylinder will be reduced or the product will be deteriorated. Another countermeasure in the case where the moving distance per one cycle exceeds the limit for reducing the diameter of the cylinder will be described later.

In operation, referring to FIG. 2, when the upper clamp 17 is lifted upward, the cylinder 4 to be formed is placed on the clamp face 13*a* of the lower clamp 13, and set at the predetermined position where the one end portion of the cylinder 4 is abutted on the stopper 19. Then, the actuator 18 is driven, so that the upper clamp 17 is moved downward, and the cylinder 4 is clamped between the lower clamp 13 and upper clamp 17, and held not to be rotated. In this case, the cylinder 4 is positioned such that the axis Xt of the cylinder 4 is aligned with the axis Xr of the main shaft 21. The transmitting member 26 is positioned at a retracted position, i.e., the right side to the position as shown in FIG. 2, so that each roller 28 is retracted outside of the outer periphery of the cylinder 4. Next, the spline shaft 8 is rotated by the servo motor 9, so that the case 20 is advanced along the X-axis guide rails 5 (moved leftward in FIGS. 2, 3), and stopped at a position where each roller 28 is retracted from the tip end of the cylinder 4 the forming length (L1 in FIG. 6). In other words, each roller 28 is positioned at the position (O1) for starting the spinning process as shown in FIG. 6, which position is set as an origin. Then, the spline shaft 15 is rotated by the servo motor 16, and the clamp device 12 is moved along the Y-axis guide rails 10 (moved downward in FIG. 3), and stopped at a position where the cylinder 4 is moved along the Y-axis guide rails 10 by the offset moving distance (S1) moved toward the eccentric shaft per one cycle. The starting position origin of the cylinder 4 may be set to a position where the axis Xt of the cylinder 4 is moved toward the axis Xr of the main shaft 21 along the Y-axis by the moving distance (S1).

Figure 7:
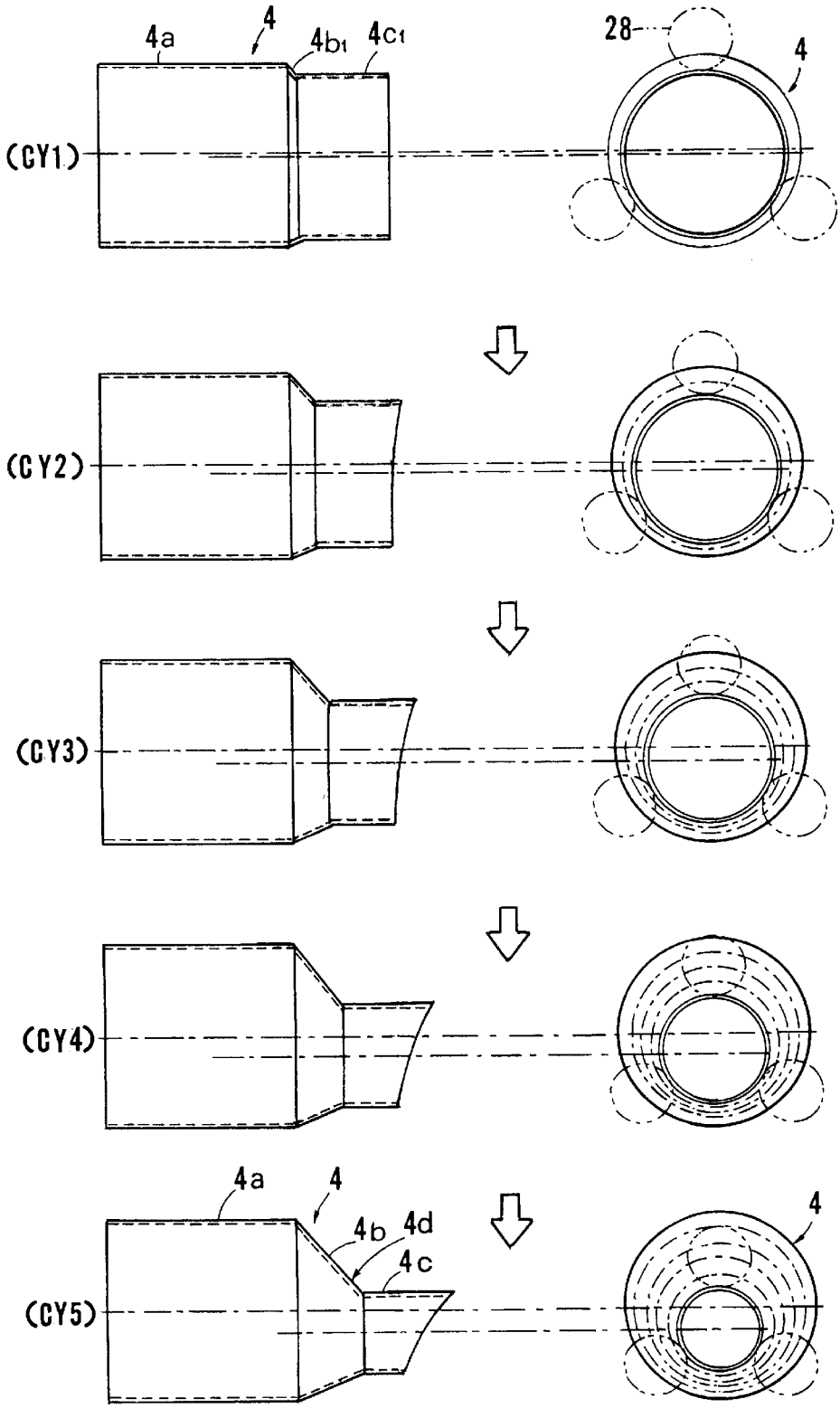
FIG. 7 illustrates a front view and side view of each end portion of the cylindrical member in the process of forming the same according to the above embodiment of the present invention.

From the state as described above, the rotary member 24 is rotated by the motor 22, and the transmitting member 26 is advanced by the actuator 25, so that each roller 28 is moved toward the center of the rotary member 24, or the axis Xr. At the same time, the spline shaft 8 is rotated by the servo motor 9, the case 20 and the roller 28 are retracted along the X-axis guide rails 5 (rightward in FIGS. 2, 3). Consequently, each roller 28 is rotated about its axis and rotated about the axis Xr of the main shaft 21 simultaneously, and moved radially toward the axis Xr, being pressed to be in contact with the outer surface of the cylinder 4, thereby to perform the spinning process. Thus, each roller 28 is started to move from the starting position (O1), until each roller 28 moves the moving distance (X1), the end portion of the cylinder is deformed by spinning, to form a tapered portion $4b_1$ in the shape of a cone with its tip end cut out and with its axis offset from the axis Xt of the main body 4*a* by the moving distance (S1), as shown in (CY1) of FIG. 7, because the axis Xr, about which the roller 28 is rotated, is offset relative to the axis Xt of the cylinder 4 by the moving distance (S1).

In the case where each roller 28 is retracted further, exceeding the moving distance (X1), the roller 28 is held to be in its state (i.e., the position moved the predetermined distance (S1)). Therefore, the end portion of the cylinder 4 is deformed in accordance with the retracting movement of each roller 28 to form a cylindrical neck portion $4c_1$, which has the central axis offset relative to the axis Xt of the main body 4*a* by the distance (S1), and which is integrally connected to the smallest diameter side of the tapered portion $4b_1$. Thereafter, the cylinder 4 and roller 28 are returned to the starting positions, thereby to provide a reciprocating motion together with the initial path for reducing the diameter of the cylinder 4, so that the spinning process in the first cycle (CY1) is completed. For simplifying the explanation about the spinning process, the operation for reducing the diameter is performed only in a single path of the reciprocating motion according to the present embodiment. However, the operation for reducing the diameter of the cylinder 4 may be performed in another path of the reciprocating motion as well, to perform the spinning process in both of the paths in one cycle, thereby to improve the forming efficiency. Furthermore, in view of the energy efficiency and tact-time, each roller 28 is continuously rotated about the axis Xr, without being stopped every cycle.

After the spinning process in the first cycle (CY1) was completed and each roller 28 was returned to the starting position, the spinning process in the second cycle (CY2) is performed. In practice, the spline shaft 8 is rotated by the servo motor 9, the case 20 and each roller 28 are advanced, and stopped in the state where each roller 28 is located in a position retracted from the tip end of the cylinder 4 by a forming length (L1−X1). At the same time, the spline shaft 15 is rotated by the servo motor 16, the clamp device 12 is moved along the Y-axis guide rails 10, and the cylinder 4 is stopped at a position where it is moved along the Y-axis by a moving distance (2·S1). From this state, the rotary member 24 is rotated, and the transmitting member 26 is advanced, so that each roller 28 is driven radially toward the axis Xr, and then each roller 28 is retracted along the X-axis guide rails 5. Consequently, each roller 28 is moved radially toward the axis Xr, being pressed to be in contact with the outer surface of the cylinder 4 thereby to perform the spinning process. In this case, each roller 28 is started to move from the starting position (O1), until each roller 28 moves a predetermined moving distance (2·X1), i.e., two times of the distance (X1) in the first cycle (CY1), the end portion of the cylinder is deformed by spinning, to form the tapered portion and neck portion, with their common axis offset from the axis Xt of the main body 4*a* by the moving distance (2·S1), because the axis Xr, about which the roller 28 is rotated, is offset relative to the axis Xt of the cylinder 4 by the moving distance (2·S1). By repeating the process as described above three more times, in the present embodiment, the reduced diameter portion 4*d* with the tapered portion 4*b* and neck portion 4*c* having the eccentric axis is formed on the end portion of the cylinder 4.

Figure 8:
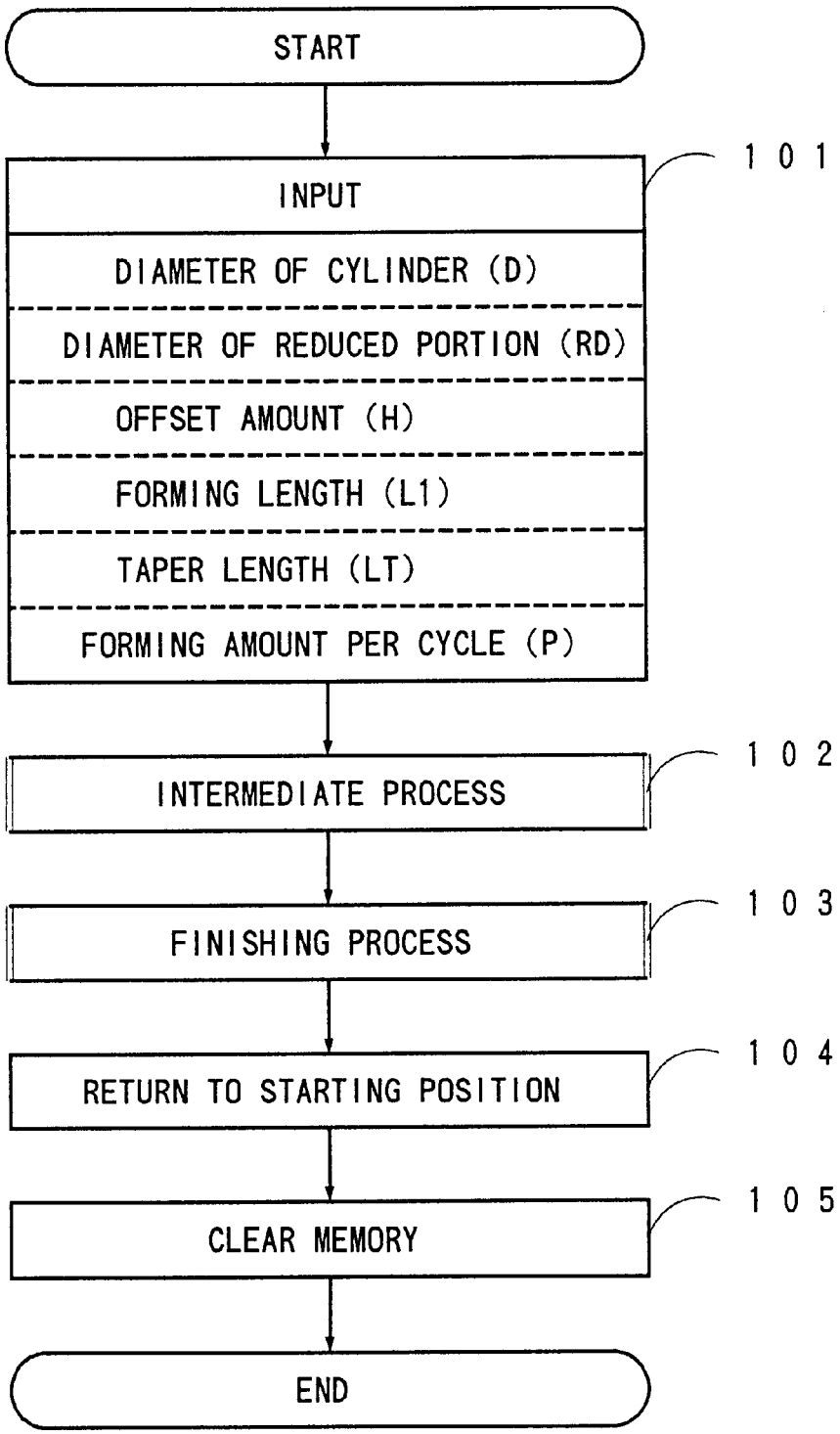
FIG. 8 is a flowchart showing a main routine of spinning according to the above embodiment of the present invention.
Figure 9:
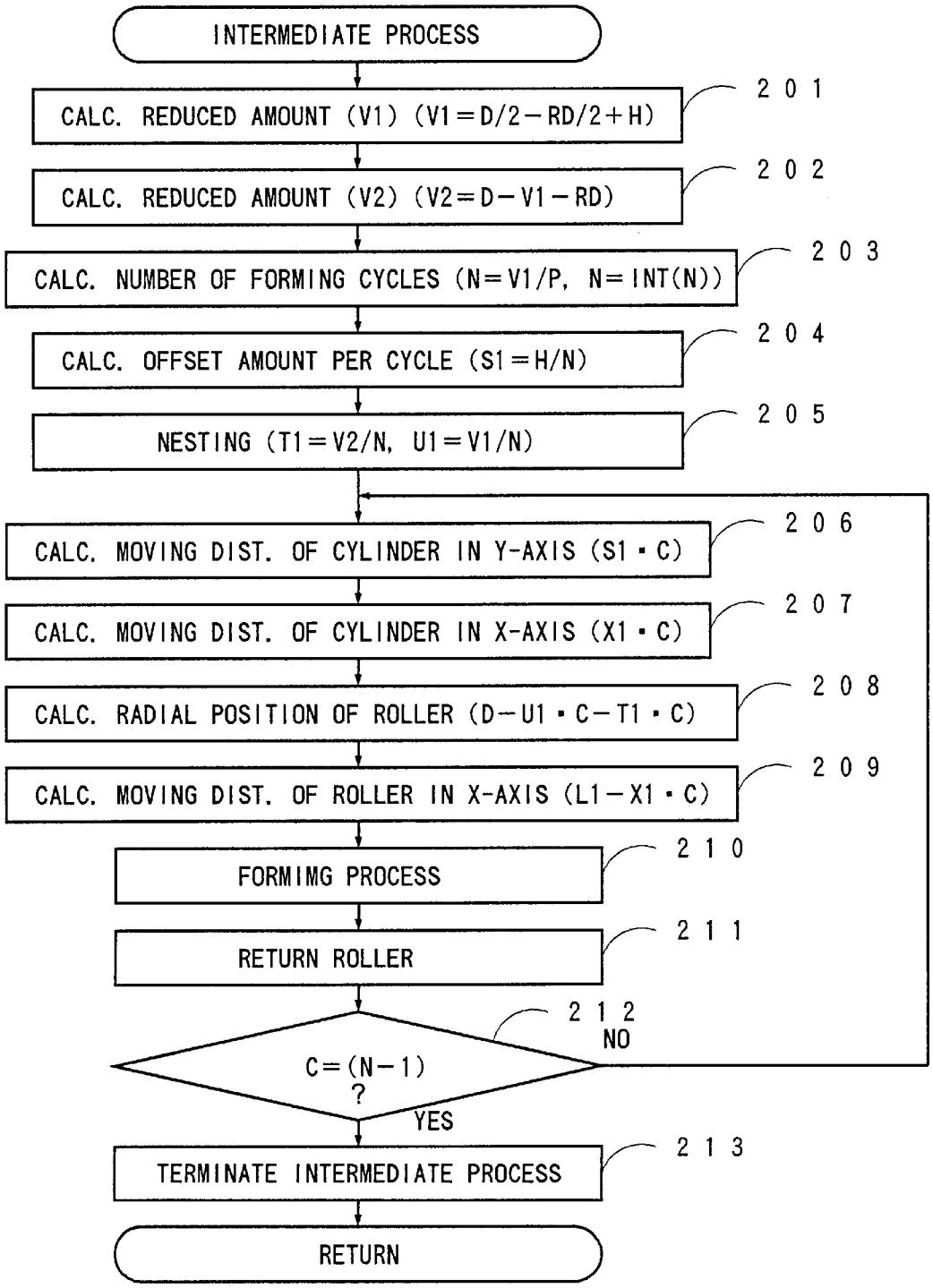
FIG. 9 is a flowchart showing a sub-routine of an intermediate process as shown in FIG. 8.
Figure 10:
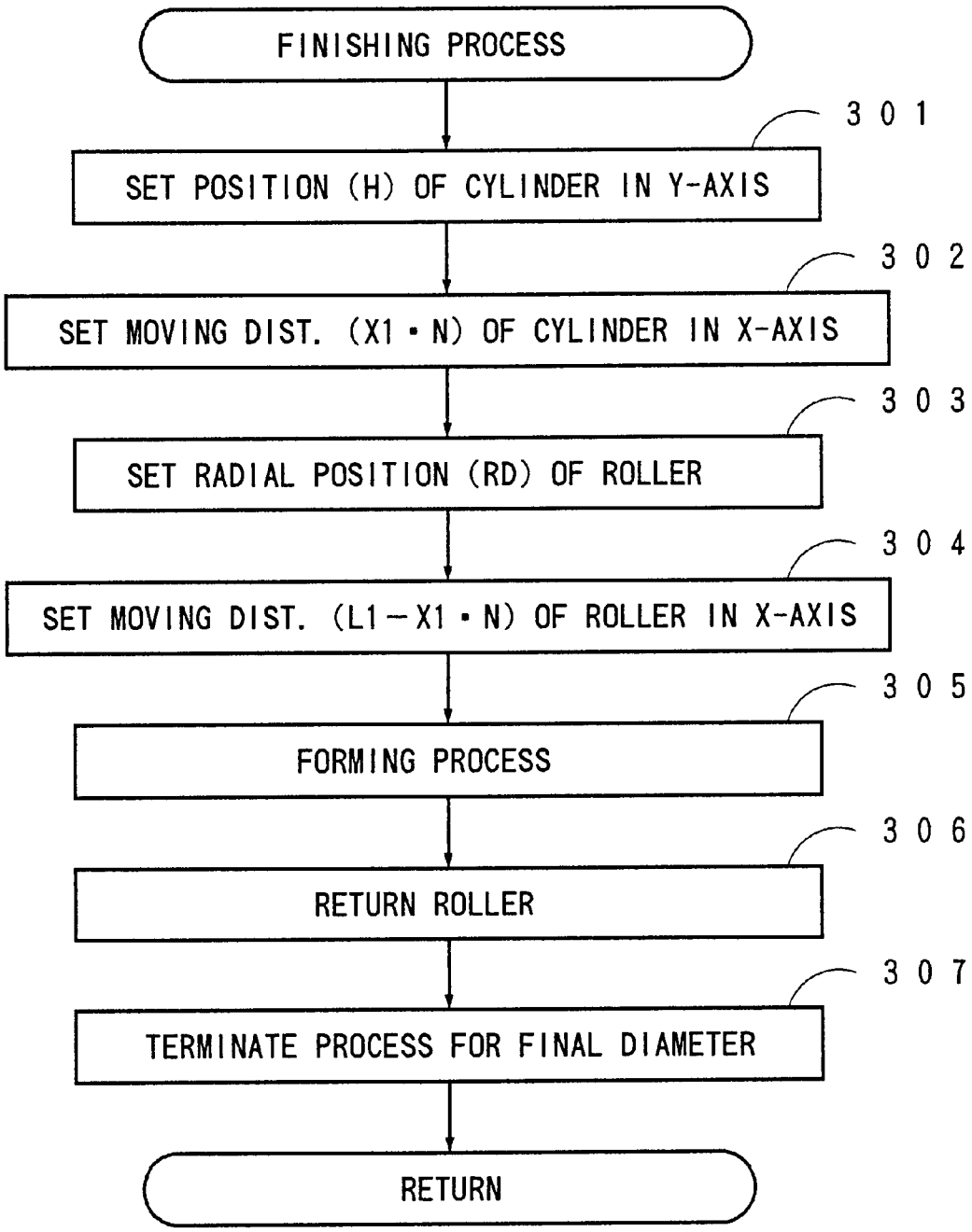
FIG. 10 is a flowchart showing a sub-routine of an finishing process as shown in FIG. 8.

Next will be explained about the overall operation of the spinning apparatus as constituted above. The spinning process as explained above with reference to FIGS. 6 and 7 will be performed by the controller CT in accordance with the flowcharts as shown in FIGS. 8–10. At the outset, various basic data are input by the input device IP at Step 101. The data input into the controller CT are the diameter (D) of the cylinder 4, target smallest diameter of the reduced diameter portion 4*d*, or diameter (RD) of the neck portion 4*c*, target offset amount (H) of the reduced diameter portion 4*d*, forming length (L1), taper length (LT), and forming amount (P) per one cycle. The forming length (L1) is a longitudinal length of a portion to be formed by the spinning process, i.e., the tapered portion 4*b* and neck portion 4*c*. The taper length (LT) is the longitudinal length of the tapered portion 4*b*. The forming amount (P) per one cycle is the longitudinal length of the portion to be formed by the spinning process in a single cycle, and set to a value which will not exceed the limit for reducing the diameter of the cylinder. Then, the program proceeds to step 102 where an intermediate process for forming the cylinder is performed, and further proceeds to Step 103 where a finishing process is performed. These intermediate and finishing processes will be described in detail later with reference to FIGS. 9 and 10. Thereafter, each component will be returned to its starting position at Step 104, and the memory ME is cleared at Step 105, so that the program will end.

The intermediate process is performed in accordance with the flowchart as shown in FIG. 9. At the outset, calculated at Steps 201 and 202 are the amount to be reduced at a portion of the cylinder which is to be formed to a relatively large extent (hereinafter, referred to as the reduced amount of the largely formed portion), and the amount to be reduced at a portion which is to be formed to a relatively small extent (hereinafter, referred to as the reduced amount of the small formed portion), respectively. The reduced amount of the largely formed portion (indicated by "V1") is a difference between the sum of the radius of the cylinder 4 and the offset amount (H), i.e., (D/2+H), and the smallest radius (RD/2). The reduced amount of the small formed portion (indicated by "V2") is a difference obtained by subtracting the reduced amount of the largely formed portion (V1) from all of the reduced amount (D−RD). Then, the program proceeds to Step 203, where number of forming process cycles by the spinning process (hereinafter, simply referred to number of forming cycles) is calculated. In practice, the reduced amount (V1) is divided by the forming amount (P) per one cycle input at Step 101, to produce a quotient (N), and the quotient (N) is rounded up to produce the integer number of forming cycles (i.e., N=INT(N)). At step 204, the moving distance (S1) in the eccentric direction per one cycle is calculated on the basis of the number (N) of forming cycles and the offset amount (H) input at Step 101. Namely, the moving distance of the cylinder 4 which is moved from the main shaft 21 along the Y-axis in a single cycle is calculated. Then, nesting is performed at Step 205 to provide U1, T1 for the reduced amounts per cycle (V1/N, V2/N).

Accordingly, the spinning process for one cycle is performed at Steps 206–211, which are repeated until a counter (C=1 to N) counts the number (N−1). In other words, after the spinning process was repeated (N−1) times, the program proceeds to Step 213 where the intermediate process is terminated. At Step 206, on the basis of the moving distance (S1) in the eccentric direction, the moving distance of the cylinder 4 which is moved along the Y-axis for the present cycle is obtained, as (S1·C). Also, at Step 207, on the basis of moving distance (X1) along the X-axis, the moving distance of the roller 28 which is moved along the X-axis for the present cycle is obtained, as (X1·C). Furthermore, the radial position of the roller 28 is calculated at Step 208, on the basis of the diameter (D) of the cylinder 4 input at Step 101, and the values (T1) and (U1) calculated at Step 205. That is, the moving distance (D−U1·C−T1·C) of the roller 28, which is moved radially from the starting position provided on the outer surface of the main body 4*a* of the cylinder 4 toward the main shaft 21 (axis Xr), is calculated. And, the moving distance (L1−X1·C) of the roller 28 which is moved along the X-axis for the present cycle, is calculated at Step 209. Based upon the calculated results, the cylinder 4 and roller 28 are moved at Step 210, and the roller 28 is rotated about the main shaft 21 to perform one cycle of the spinning operation, and then the roller 28 returns to its starting position at Step 211. Then, the value (C) counted by the counter is compared with the predetermined number (N−1), and the Steps 206–211 are repeated until the counter counts up the predetermined number (N−1). When it is determined at Step 212 that the value (C) counted by the counter has reached the predetermined number (N−1), the program proceeds to Step 213 where the intermediate process is terminated, so that the program return to the main routine in FIG. 8.

The finishing process executed at step 103 will be performed in accordance the flowchart as shown in FIG. 10. At the outset, the offset amount (H) to be formed, which was input at Step 101, is set as the position of the cylinder 4 on the Y-axis at Step 301, and the moving distance (X1·N) of the cylinder 4 which is moved along the X-axis, is obtained at Step 302. Also, the diameter (RD) of the reduced diameter portion 4*d* to be formed is set as the radial position of the roller 28 at Step 303. Then, the moving distance (L1−X1·N) of the roller 28 which is moved along the X-axis, is calculated at Step 304. Based upon these calculated results, the cylinder 4 and roller 28 are moved at Step 305, and the roller 28 is rotated about the main shaft 21 to perform the final spinning process, and then the program proceeds to Step 306 where the roller 28 returns to the starting position. Consequently, the forming process for obtaining the final diameter (RD) is terminated at Step 307, and the program returns to the main routine in FIG. 8.

According to the present embodiment, therefore, a plurality of forming processes are performed, in the condition that the roller 28 is always in contact with the surface of the cylinder 4 to be formed, not only a smoothly formed surface can be obtained, but also reduction in thickness of the formed portion, or biased thickness thereof will be minimized to ensure a desired strength. Furthermore, since the forming process is not performed in so severe conditions, the overall forming limit will be improved. As a result, the reduced diameter portion can be made to have a larger offset amount, or larger reduced rate than those in the embodiment as shown in FIG. 15, for example. In this case, no excessive load will be applied to the roller 28 or the like, the forming process can be performed smoothly and calmly. In the case where the reduced amount of the small formed portion (V2) exceeds the limit for reducing the diameter of the cylinder 4 per cycle, the above forming process shall be employed, until the reduced amount of the small formed portion (V2) will not exceed the limit for reducing the diameter of the cylinder. After the reduced amount of the small formed portion (V2) becomes not to exceed the limit, the process may be made in accordance with the same process as disclosed in FIG. 11, which will be described later in detail.

Figure 11:
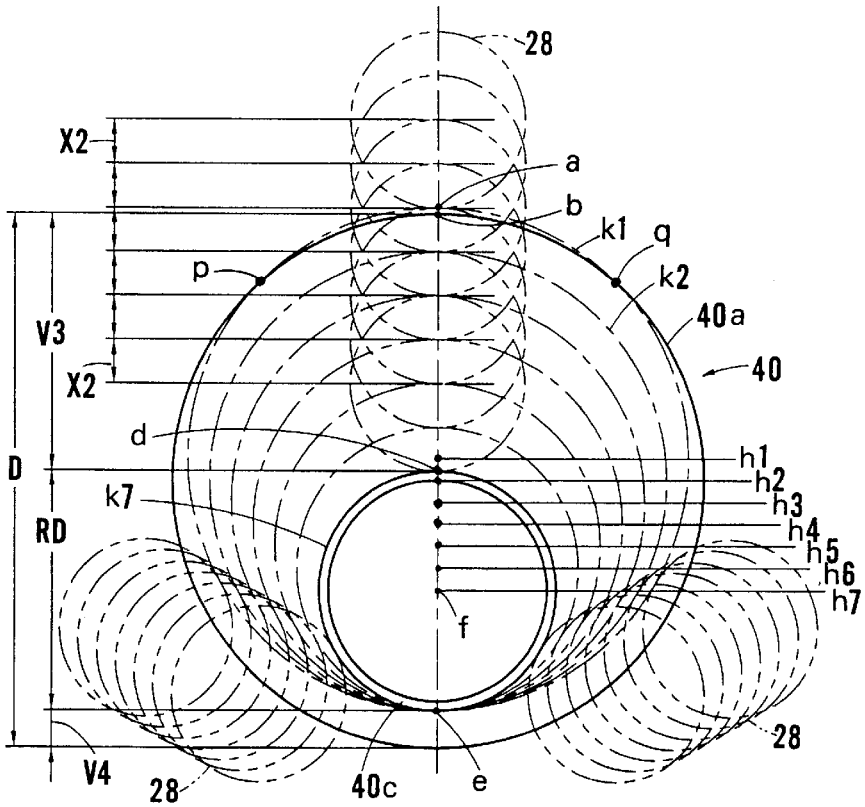
FIG. 11 is a diagram showing a basic concept for reducing the diameter of the end portion of the cylindrical member according to another embodiment of the present invention.
Figure 12:
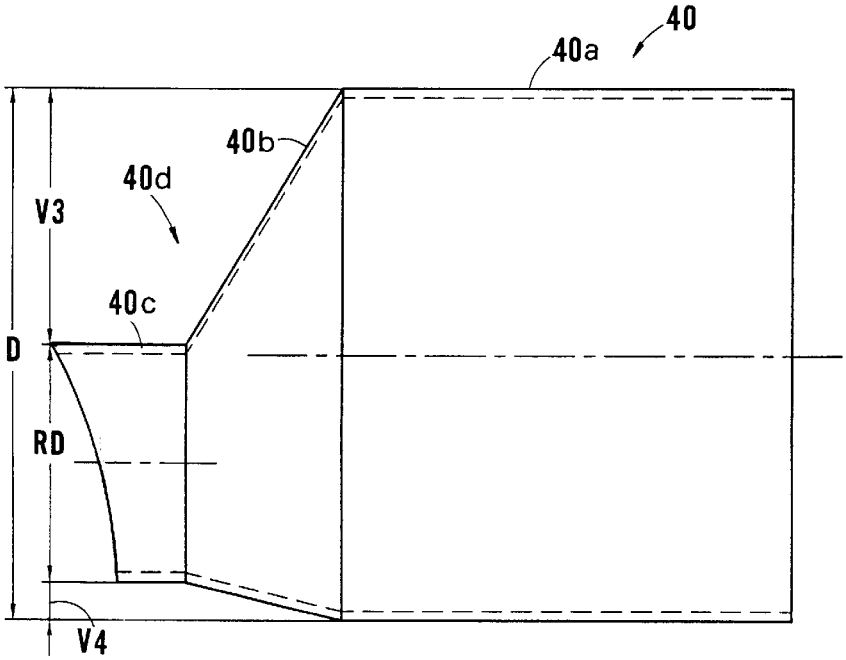
FIG. 12 is a side view of the cylindrical member according to another embodiment of the present invention.

FIG. 11 shows the basic concept for reducing the diameter of the end portion of the cylinder according to another embodiment, and FIG. 12 illustrates a cylinder 40 to which the spinning process was made. This embodiment relates to the method for reducing the diameter of the cylinder, when the reduced amount of the small formed portion (indicated by "V4" in this case) will not exceed the limit for reducing the diameter of the cylinder in a single cycle, as will be explained in accordance with the forming steps hereinafter. In FIG. 11, thick solid lines indicate the front configuration of the formed cylinder 40. The target diameter to be formed in the last forming cycle is set to correspond to the diameter of the formed neck portion 40*c*. The target diameters larger than the diameter of the formed neck portion 40*c* are set to trace a position "e" where the outer diameter of the neck portion 40*c* abut on the vertical line as shown in FIG. 11. In other words, it is so arranged that the roller 28 always traces a predetermined position where the distance from the outer diameter of the cylinder 40 to the eccentric axis is constant, every cycle. In FIG. 11, the reduced amount of the largely formed portion (indicated by "V3" in this case) corresponds to the distance between positions "b" and "d". The structure of the cylinder 40 is the same as that of the cylinder 4 as described heretofore (numerical reference "40" is used in FIGS. 11, 12 for "4" in the previous drawings), so that explanation thereof will be omitted.

In the embodiment as shown in FIGS. 11, 12, when the reduced amount of the largely formed portion (V3) is divided by a limit for forming to reduce the diameter by one cycle (indicated by "X2" herein), the number of forming cycles (e.g., 7 cycles in FIG. 1) is obtained. In this case, the number is rounded up to be the integer, so that an intersection (a) of the vertical line and the forming target of the largest diameter is located outside of the position (b). Therefore, a radially moving distance of the roller 28 in one path is set to be smaller than the limit for forming to reduce the diameter by one cycle (X2). The radially moving distance of the roller 28 in one path may be set to be equal in each cycle, or may be divided by a different ratio between the starting stage and the terminating stage as described before. Then, a diameter of a circle to be formed (forming target) including the starting position of the forming process by each roller 28 is calculated for each cycle. As a result, the center of each forming target is as indicated by (h1) to (h6) in FIG. 11, while (h7) corresponds to the center of the neck portion 40*c*. Accordingly, when the first cycle starts, each roller 28 is rotated to trace the forming target (k1) of the largest circle about the position (h1) as its center. Thereafter, with the center shifted from (h2) to (h7), the diameter of the forming target is reduced from (k2) to (k7), so that the cylinder 40 as shown in FIG. 12 is formed in the seventh cycle.

According to the present embodiment, a plurality of forming processes are performed, in the condition that the roller 28 is always in contact with the surface of the cylinder 40 to be formed, in such a manner that the roller 28 always traces a predetermined position where a distance from the outer diameter of the cylinder 40 to the eccentric axis is constant, within the limit for forming to reduce the diameter by one cycle, i.e., substantially always traces the position (e), except for an exceptional part from a position (p) to a position (q). Therefore, the forming process is easy, no excessive load will be applied to the roller 28 or the like, and the forming process can be performed smoothly and calmly. And, the smoothly formed surface can be obtained, and the desired strength can be obtained, as in the former embodiment.

Figure 13:
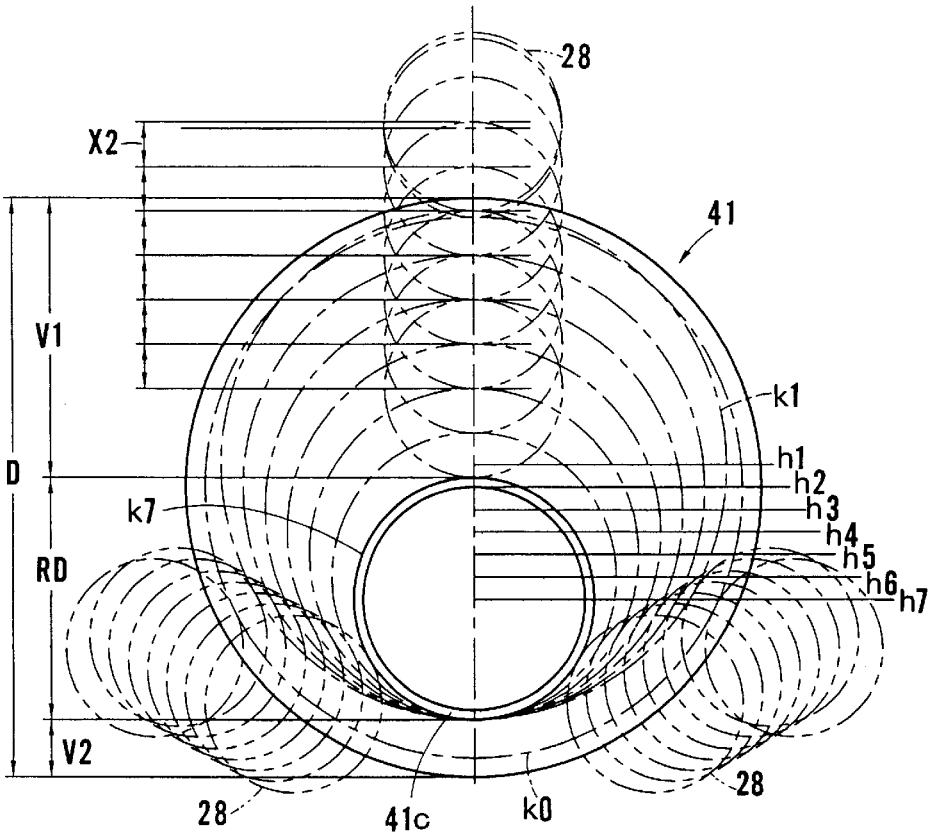
FIG. 13 is a diagram showing a basic concept for reducing the diameter of the end portion of the cylindrical member according to a further embodiment of the present invention.
Figure 14:
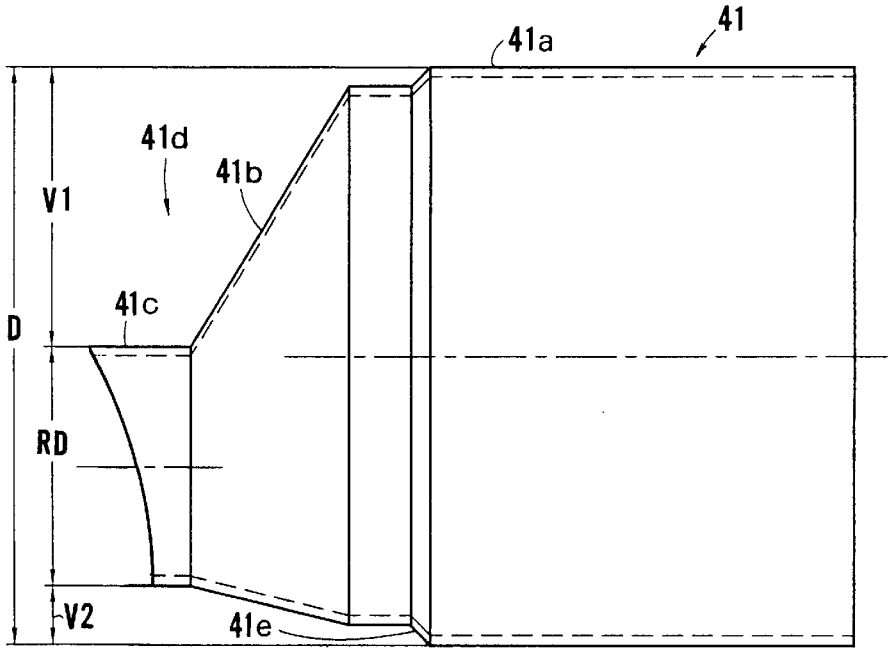
FIG. 14 is a side view of the cylindrical member according to a further embodiment of the present invention.

FIG. 13 shows the basic concept for reducing the diameter of the end portion of the cylinder according to a further embodiment, and FIG. 14 illustrates a cylinder 41 to which the spinning process was made. This embodiment relates to the method for reducing the diameter of the cylinder, when the reduced amount of the small formed portion (V2) will exceed the limit for reducing the diameter of the cylinder in a single cycle. Until such a condition is fulfilled that the reduced amount of the small formed portion does not exceed the limit for reducing the diameter of the cylinder by one cycle, the spinning process will be made, with the axis of the cylinder 41 aligned with the main shaft 21. After such a condition that the reduced amount of the small formed portion does not exceed the limit for reducing the diameter of the cylinder has been fulfilled, the forming process will be performed in accordance with the same manner as that in the embodiment in FIG. 11. That is, the forming target to the cylinder 41 for the first cycle is set to be a circle (indicated by "k0" in FIG. 13) about the central axis of the cylinder 41, which is common to the central axis the outer periphery of the cylinder 41. Thereafter, with the center shifted from (h1) to (h7), the diameter of the forming target is reduced from (k1) to (k7), so that the cylinder 41 as shown in FIG. 14 is completed in the eighth cycle.

According to the present embodiment, therefore, a stepped portion 41*e* is formed on the cylinder 41 as shown in FIG. 14. The forming process can be performed rapidly, until such a condition that the reduced amount of the small formed portion does not exceed the limit for reducing the diameter of the cylinder is fulfilled, so that the forming time period can be reduced. Also, the roller 28 is always in contact with the surface of the cylinder 41 to be formed, no excessive load will be applied to the roller 28 or the like, and the forming process can be performed smoothly and calmly.

Figure 16:
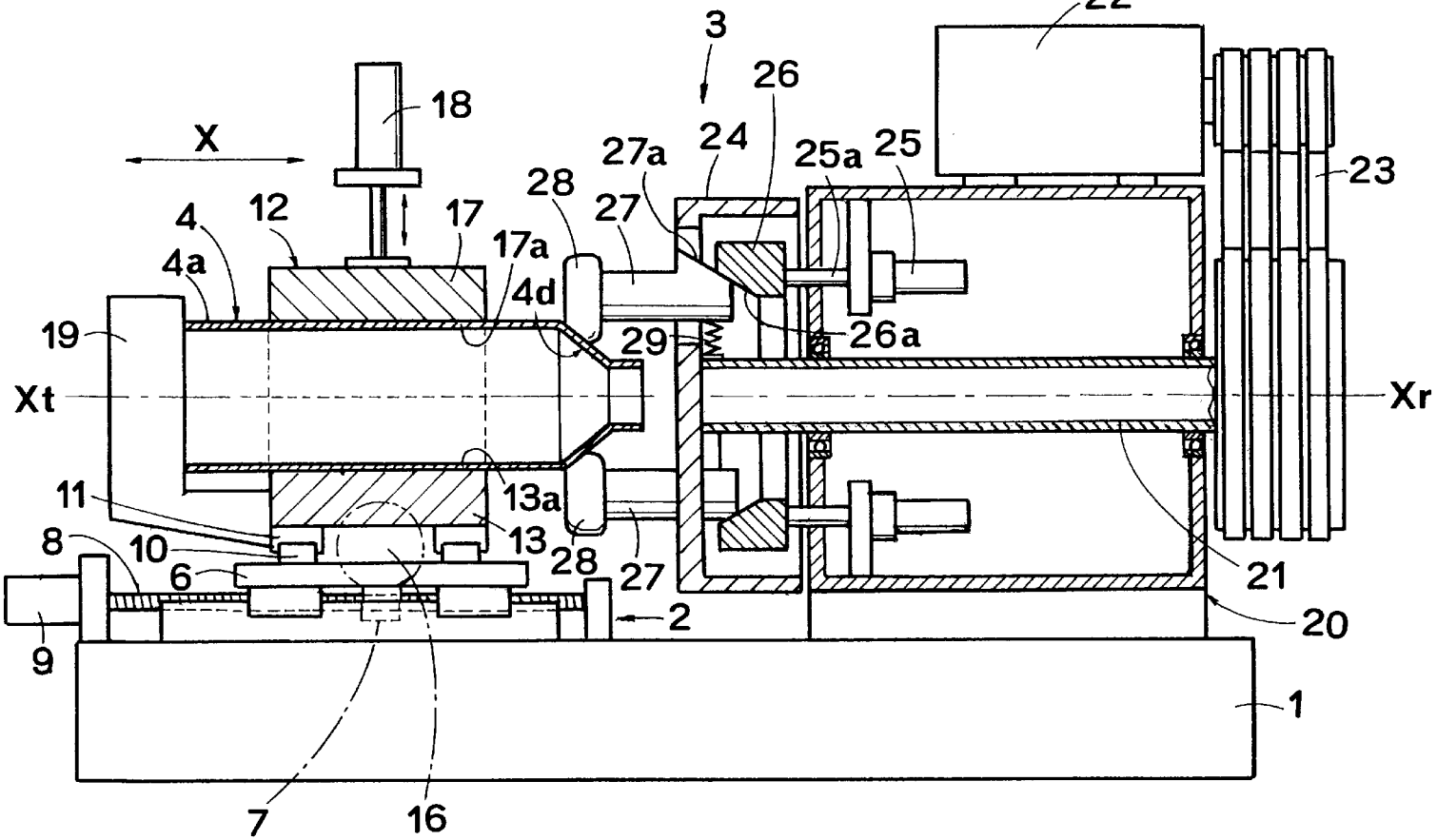
FIG. 16 is a side view of the spinning apparatus with a portion thereof sectioned according to another embodiment of the spinning apparatus.
Figure 17:
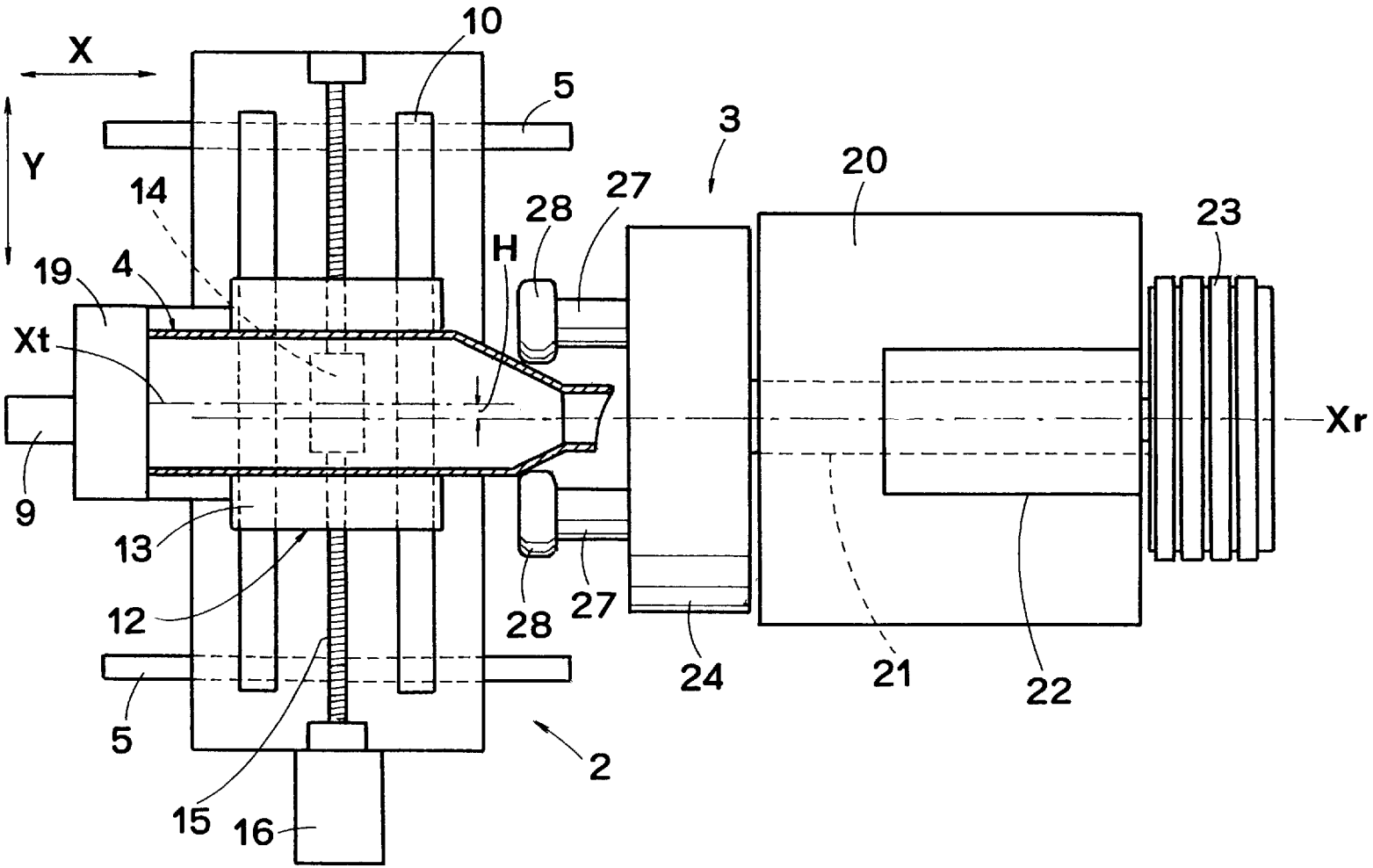
FIG. 17 is a plan view of the spinning apparatus with a portion thereof sectioned according to another embodiment of the spinning apparatus.

FIGS. 16, 17 illustrate the spinning apparatus according to another embodiment. In the embodiment as disclosed in FIGS. 2, 3, the case 20 is moved along the X-axis and the cylinder 4 is moved along the Y-axis, so that they are moved relative to each other, whereas according to the present embodiment, the case 20 is secured to the base 1, and the cylinder 4 is moved along the X-axis and Y-axis. That is, the first driving mechanism 2 that serves as the first driving means according to the present invention are gathered in the right side in FIGS. 16, 17. The rest of the components such as the second driving mechanism 3 are the same as those in the aforementioned embodiment. Therefore, the components in FIGS. 16, 17 having substantially the same function as those in FIGS. 2, 3 are identified by the same reference numerals in FIGS. 2, 3.

In the first driving mechanism 2, a pair of X-axis guide rails 5 are fixedly secured to the base 1 at the left side thereof in FIGS. 16, 17. A table 6 is arranged to be movable along the X-axis guide rails 5. And the ball socket 7 is secured to the table 6 thereunder, and the spline shaft 8 to be engaged with the ball socket 7 is mounted on the base 1 in parallel with the X-axis guide rails 5, to be rotated by the servo motor 9. Accordingly, when the spline shaft 8 is rotated by the servo motor 9, the table 6 is moved along the X-axis. Furthermore, a pair of Y-axis guide rails 10 are secured to the table 6 thereon, and a pair of sliders 11 are movably mounted on the Y-axis guide rails 10. The same clamp device 12 as that shown in FIGS. 2, 3 is mounted on the sliders 11, so that when the spline shaft 15 is rotated by the servo motor 16, the clamp device 12 is moved along the Y-axis relative to the table 6.

According to the present embodiment, the spline shaft 8 is rotated by the servo motor 9, so that the clamp device 12 is advanced along the X-axis guide rails 5 (i.e., moved rightward in FIGS. 16, 17), and stopped when each roller 28 is located at a position where the clamp device 12 is retracted from the tip end of the cylinder 4 by the forming distance (indicated by "L1" in FIG. 6). And, the spline shaft 15 is rotated by the servo motor 16, so that the clamp device 12 is moved along the Y-axis guide rails 10 (i.e., moved downward in FIG. 17), and stopped when the cylinder 4 is located at a position where it is moved along the Y-axis by the offset moving distance per cycle (S1). Then, the motor 22 is rotated by the rotary member 24, the transmitting member 26 is advanced by the actuator 25, and each roller 28 is moved toward the center of the rotary member 24 (i.e., the axis Xr). At the same time, the spline shaft 8 is rotated by the servo motor 9, so that the clamp device 12 and the cylinder 4 are retracted along the X-axis guide rails 5 (i.e., moved leftward in FIGS. 16, 17). Consequently, each roller 28 is rotated about its axis and rotated about the axis Xr of the main shaft 21 simultaneously, to be moved radially toward the axis Xr, being biased to be in contact with the outer surface of the cylinder 4, thereby to perform the spinning process, in the same manner as in FIGS. 2 and 3.

Figure 18:
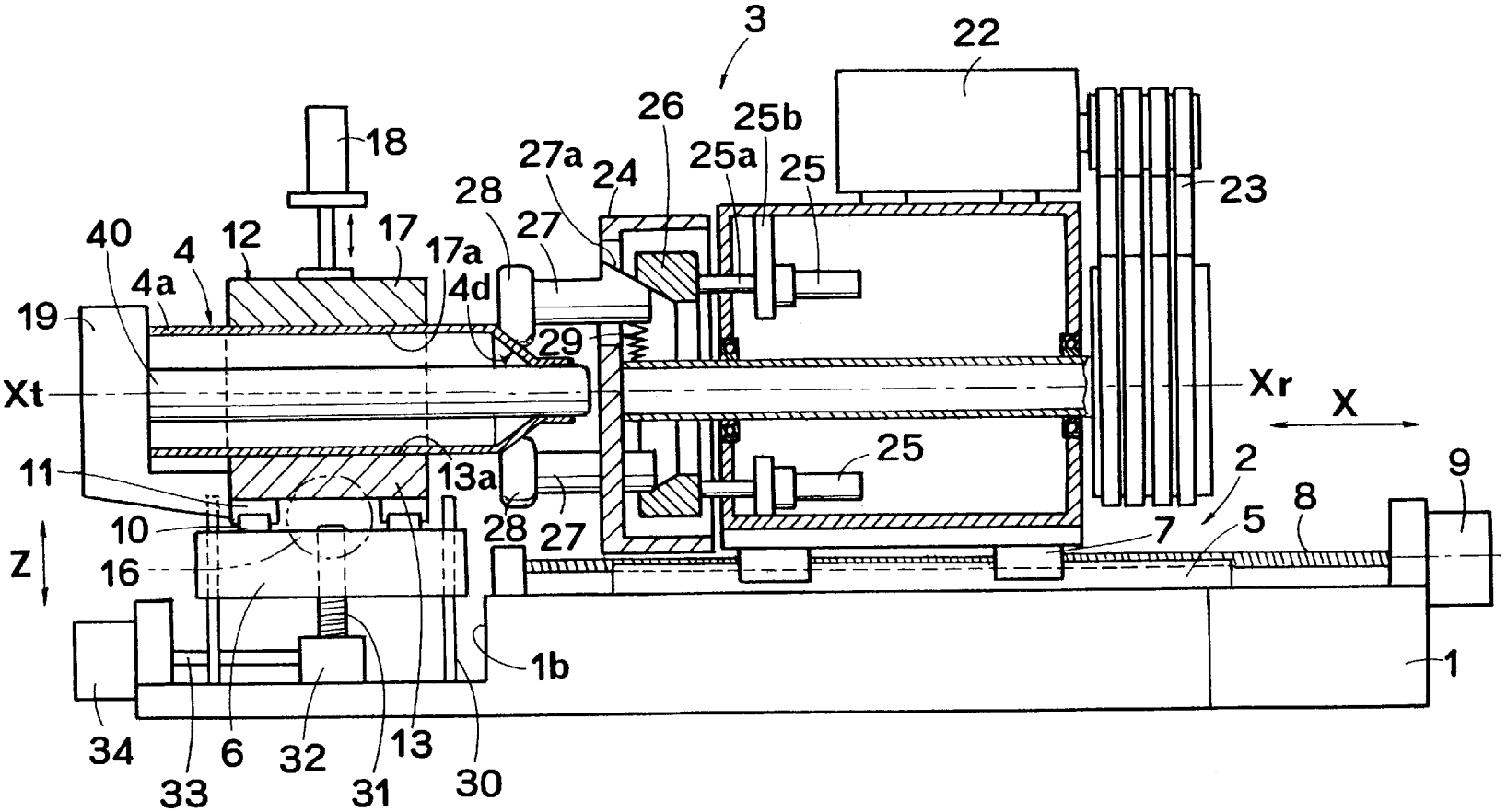
FIG. 18 is a side view of the spinning apparatus with a portion thereof sectioned according to a further embodiment of the spinning apparatus.
Figure 19:
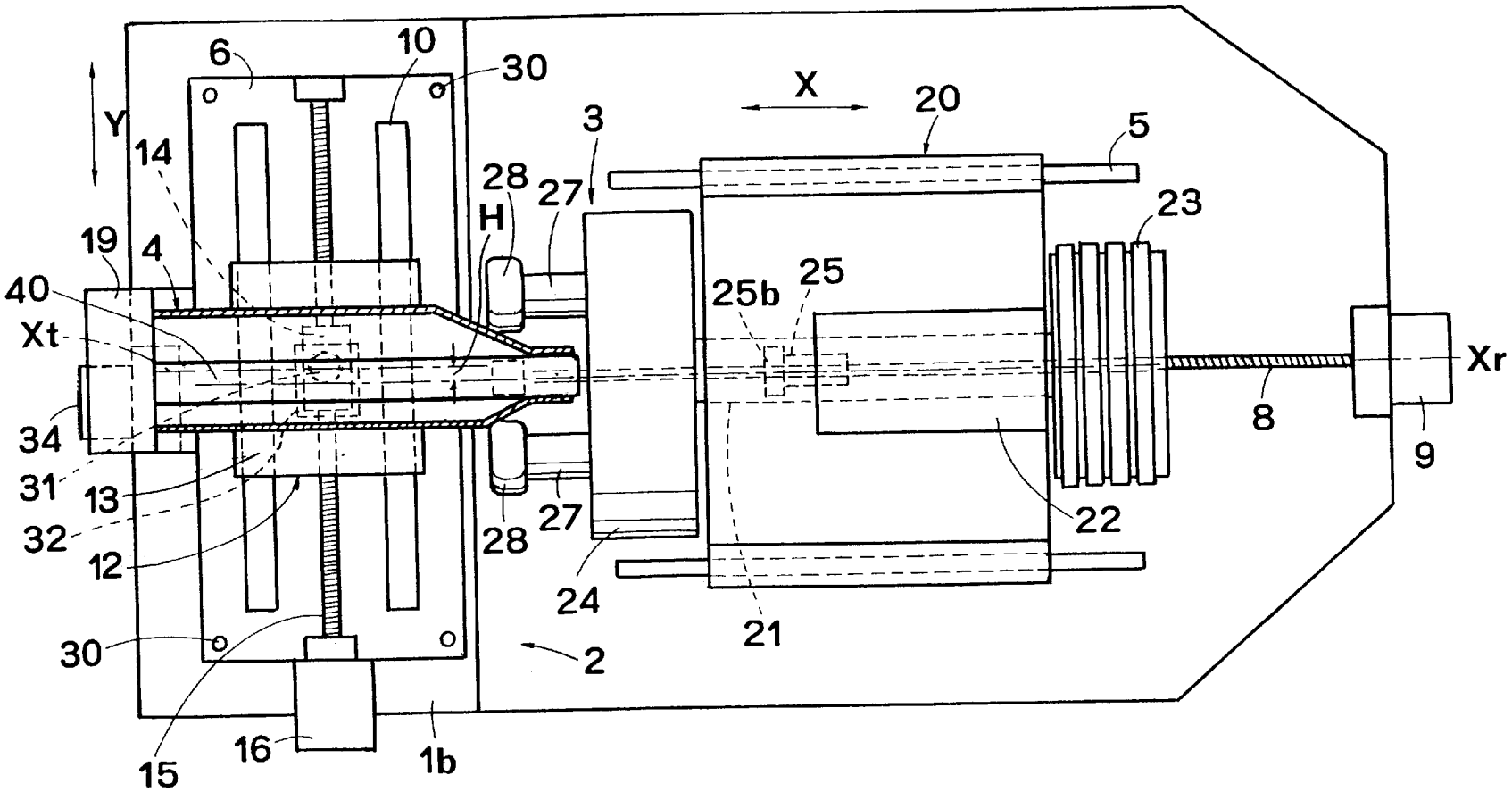
FIG. 19 is a plan view of the spinning apparatus with a portion thereof sectioned according to further embodiment of the spinning apparatus.

FIGS. 18, 19 illustrate the spinning apparatus according to a further embodiment. In the embodiment as disclosed in FIGS. 2, 3, the axis Xt of the cylinder 4 is fixed to a position of a predetermined height above the base 1, so as to be placed on the same plane as the axis Xr of the main shaft 21 in parallel with the base 1, whereas according to the present embodiment, the height of the axis Xt of the cylinder 4 to the base 1 is adapted to be variable, and the axis Xt can be adjusted vertically relative to the axis Xr of the main shaft 21. In other words, the present embodiment further include a third driving mechanism that drives the cylinder 4 vertically, having the same first driving mechanism 2 and second driving mechanism 3 as those shown in FIGS. 2, 3. In addition, a mandrel 40 is secured to the stopper 19 according to the present embodiment. The rest of the components in FIGS. 18, 19 having substantially the same function as those in FIGS. 2, 3 are identified by the same reference numerals in FIGS. 2, 3.

According to the third driving mechanism in the present embodiment, formed on a portion of the base 1 (left side in FIGS. 18, 19) is a recess 1*a*, on which four Z-axis guide posts (represented by "30") are mounted vertically. The table 6 is disposed to be vertically movable along the Z-axis guide posts 30. Between the table 6 and the recess 1*a*, a gear box 32 is disposed to be engaged with a vertical spline shaft 31, which is engaged with a hole defined in the table 6. The gear box 32 is connected to a servo motor 34, which is secured to the base 1, through a connecting shaft 33. When the connecting shaft 33 is rotated by the servo motor 34, the spline shaft 31 is rotated through the gear box 32, so that the table 6 is moved vertically, i.e., lifted up and down. Therefore, the axis Xt of the cylinder 4 can be adjusted to be located at a predetermined vertical position relative to the base 1, and the axis Xt can be adjusted vertically relative to the axis Xr of the main shaft 21. Consequently, the axis of the neck portion 4*c* can be made offset along not only the Y-axis but also the Z-axis, so that a fine adjustment will be made easily in the spinning process.

Furthermore, the mandrel 40 of a columnar configuration is supported on the stopper 19 so as to correspond to the eccentric axis of the cylinder 4 to be formed, in parallel with the axis Xt of the cylinder 4, as shown in FIGS. 18, 19. The position of the mandrel 40 to be mounted on the stopper 19 is adjustable (not shown). The diameter of the mandrel 40 is set to be the same as the inner diameter of the last configuration of the neck portion 4*c* formed on the cylinder 4. When the finishing process is made, therefore, the spinning process is performed in the condition that the neck portion 4*c* is clamped between the mandrel 40 and the roller 28, the finished outer surface of the neck portion 4*c* can be easily formed into smooth surface. Explanation about other operations will be omitted, because they are substantially the same as those explained previously.

Figure 20:
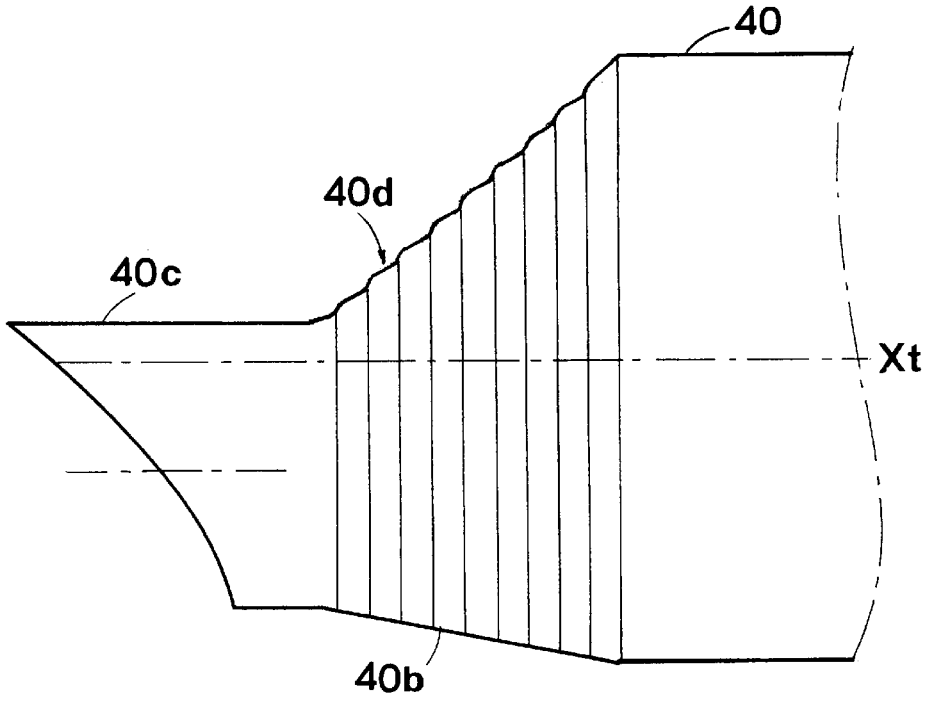
FIG. 20 is a side view of the end portion of the cylindrical member formed in accordance with the method for forming the end portion of the cylindrical member as shown in FIG. 11.
Figure 21:
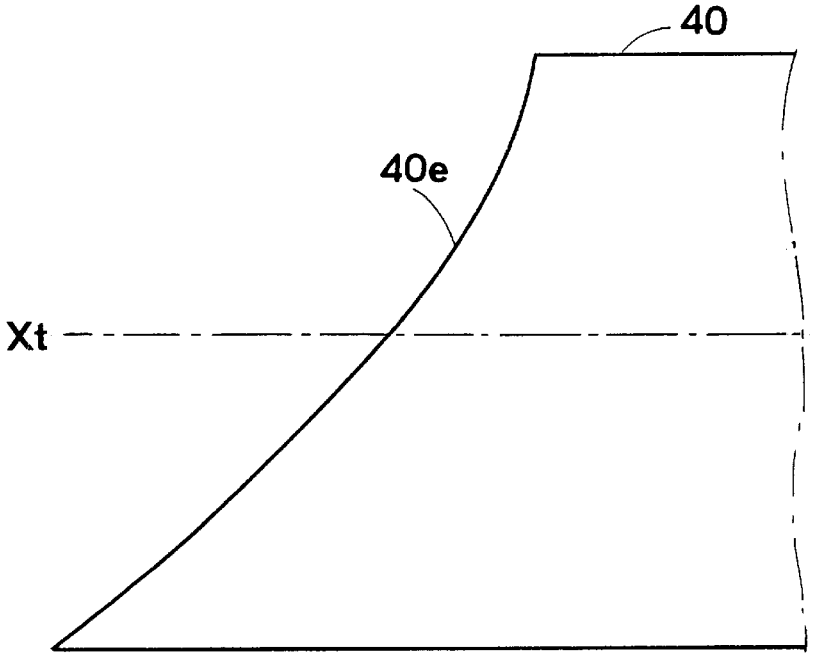
FIG. 21 is a side view of the end portion of the cylindrical member to be formed in accordance with the method for forming the end portion of the cylindrical member as shown in FIG. 11, to form an end portion of the neck portion into a vertical plane to the axis of the cylindrical member.

FIG. 20 illustrates the configuration of the finished end portion of the cylinder 40, which was formed according to the method for forming the end portion of the cylinder as shown in FIG. 11. The configuration of the open end of the neck portion 40*c* is formed to be inclined to a quite large extent, as clearly shown in FIG. 20. Therefore, the open end of the neck portion 4*c* shall be cut out by a surface vertical to the axis Xt, in accordance with a general approach to solve it. In order to omit such a cutting process, firstly, the configuration of the cylinder 40 to be formed is formed in advance to provide an opening end 40*e* with an inclined side configuration, as shown in FIG. 21, secondary, the spinning is performed, with the cylinder 40 arranged to be opposite to the inclined configuration of the neck portion 40*c*. Consequently, the open end with the vertical surface to the axis Xt of the finished neck portion 40*c* can be formed.

Figure 22:
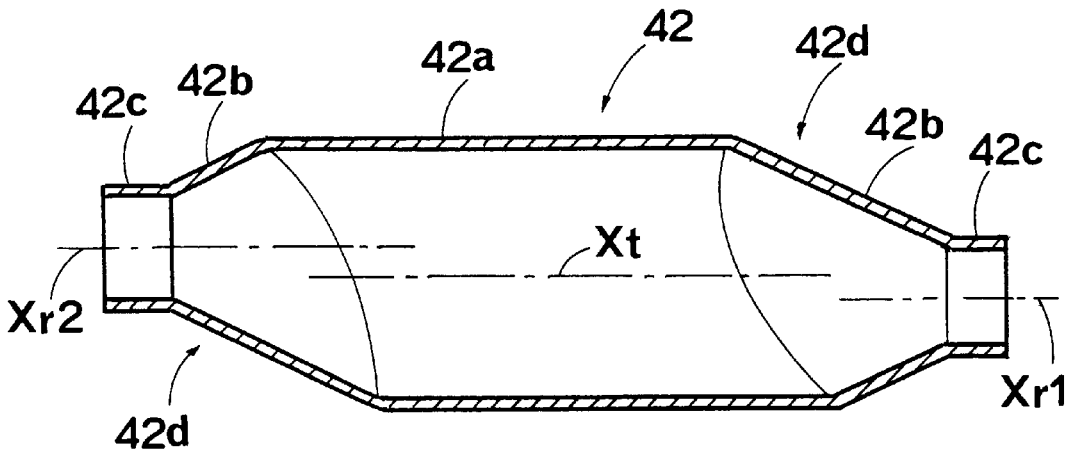
FIG. 22 is a sectional view of a cylinder formed by the spinning process according to a further embodiment of the present invention.
Figure 23:
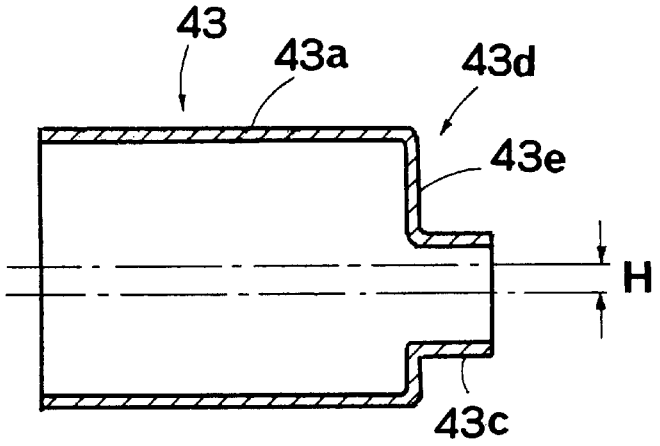
FIG. 23 a sectional view of a cylinder with a vertical end face and a neck portion formed by the spinning process according to a yet further embodiment of the present invention.

FIG. 22 illustrates the configuration of a cylinder 42 with opposite end portions formed by the spinning process. And, FIG. 23 illustrates the configuration of a cylinder 43 with a vertical end face 43*e* and a neck portion 43*c* formed by the spinning process. The neck portion 43*c* in FIG. 23 has also the eccentric axis offset from the central axis by the offset amount (H).

It should be apparent to one skilled in the art that the above-described embodiments are merely illustrative of but a few of the many possible specific embodiments of the present invention. Numerous and various other arrangements can be readily devised by those skilled in the art without departing from the spirit and scope of the invention as defined in the following claims.

What is claimed is:

1. A method for forming an end portion of a cylindrical member by spinning, said method comprising the steps of:

supporting at least one roller to be radially moved to and from a main shaft;

holding said cylindrical member to position the central axis thereof in parallel with said main shaft; and driving at least one of said cylindrical member and said at least one roller to be rotated relative to each other about an eccentric axis offset from the central axis of said cylindrical member, with said at least one roller radially moved to be in contact with the outer side of one end portion of said cylindrical member, to form a reduced diameter portion on the one end portion of said cylindrical member.

2. The method of claim 1, wherein said driving step includes the step of moving said at least one roller radially in accordance with a plurality of spinning cycles.

3. The method of claim 1, wherein said supporting step includes the steps of:

positioning said main shaft on a plane including the central axis of said cylindrical member, in parallel therewith; and supporting at least one roller on said main shaft to be radially moved to and from said main shaft, and wherein said driving step includes the steps of:

moving at least one of said cylindrical member and said at least one roller relative to each other, with the central axis of said cylindrical member held in parallel with said main shaft;

moving said at least one roller radially toward the eccentric axis offset from the central axis of said cylindrical member, with said at least one roller being in substantial contact with the outer surface of the one end portion of said cylindrical member; and driving at least one of said cylindrical member and said at least one roller to be rotated relative to each other about the eccentric axis of said cylindrical member.

4. The method of claim 3, wherein said driving step includes the step of moving at least one of said cylindrical member and said at least one roller relative to each other, to move the central axis of said cylindrical member and the eccentric axis thereof gradually close to each other, in accordance with a plurality of cycles repeated during the rotating operation of at least one of said cylindrical member and said at least one roller.

5. The method of claim 4, wherein at least one of said cylindrical member and said at least one roller is adapted to be rotated relative to each other, to trace a predetermined position where a distance from the outer surface of said cylindrical member to the eccentric axis thereof is constant, every cycle of the rotating operation of at least one of said cylindrical member and said at least one roller.

6. The method of claim 5, wherein when a difference between the outer diameter of said cylindrical member and a desired outer diameter of the reduced diameter portion of said cylindrical member to be formed exceeds a predetermined forming limit, said cylindrical member and said at least one roller are rotated about the same axis as the central axis of said cylindrical member, until the difference will become smaller than said predetermined forming limit.

7. The method of claim 1, wherein said reduced diameter portion is formed to provide a tapered portion, with the diameter of said cylindrical member gradually reduced from a main body thereof toward the tip end thereof.

8. The method of claim 7, wherein said reduced diameter portion is formed to provide said tapered portion and a neck portion of a tubular configuration extending from the tip end of said tapered portion, with the central axis of said neck portion positioned in parallel with the central axis of said cylindrical member.

9. An apparatus for forming an end portion of a cylindrical member by spinning, comprising:

a main shaft positioned on a plane including the central axis of said cylindrical member, in parallel therewith;

at least one roller mounted on said main shaft to be radially movable to and from said main shaft, and in contact with the end portion of said cylindrical member;

first driving means for moving at least one of said cylindrical member and said at least one roller relative to each other, in parallel with the central axis of said cylindrical member and said main shaft;

second driving means for moving said at least one roller radially toward an eccentric axis offset from the central axis of said cylindrical member, with said at least one roller being in substantial contact with the outer surface of the one end portion of said cylindrical member, and rotating said at least one roller about said main shaft relative to said cylindrical member; and control means for controlling said first driving means and second driving means to form a reduced diameter portion on the one end portion of said cylindrical member.

10. The apparatus of claim 9, wherein said first driving means is adapted to move at least one of said cylindrical member and said at least one roller relative to each other, to move the central axis of said cylindrical member and the eccentric axis thereof gradually close to each other in accordance with a plurality of spinning cycles, and wherein said second driving means is adapted to rotate said at least one roller about said main shaft relative to said cylindrical member every cycle.

11. The apparatus of claim 10, wherein said first driving means is adapted to move at least one of said cylindrical member and said at least one roller relative to each other, to have said roller trace a predetermined position where a distance from the outer surface of said cylindrical member to the eccentric axis thereof is constant, every cycle.

12. The apparatus of claim 11, wherein said first driving means is adapted to move at least one of said cylindrical member and said at least one roller relative to each other, with the central axis of said cylindrical member and said main shaft aligned with each other, until a difference between the outer diameter of said cylindrical member and a desired outer diameter of the reduced diameter portion of said cylindrical member to be formed becomes smaller than a predetermined forming limit.

13. The apparatus of claim 9, wherein said second driving means includes a plurality of rollers moved radially toward said main shaft, and rotated about said main shaft.

14. The apparatus of claim 9, further comprising third driving means for moving at least one of said cylindrical member and said at least one roller relative to each other, vertically to said plane including the central axis of said cylindrical member.

15. The apparatus of claim 9, wherein said reduced diameter portion is formed to provide a tapered portion, with the diameter of said cylindrical member gradually reduced from a main body thereof toward the tip end thereof.

16. The apparatus of claim 9, wherein said reduced diameter portion is formed to provide said tapered portion and a neck portion of a tubular configuration extending from the tip end of said tapered portion, with the central axis of said neck portion positioned in parallel with the central axis of said cylindrical member.

* * * * *

UNITED STATES PATENT AND TRADEMARK OFFICE

CERTIFICATE OF CORRECTION

PATENT NO. : 6,018,972

DATED : February 1, 2000

INVENTOR(S) : Tohru Irie, Nagoya, Japan

It is certified that error appears in the above-identified patent and that said Letters Patent is hereby corrected as shown below:

Title page,

Please add:

item [56] References Cited

U.S. PATENT DOCUMENTS

| | | |
|---|---|---|
| 4,143,535 | 3/1979 | Bouman |
| 5,570,603 | 11/1996 | Chatterly et al. |
| 3,533,259 | 10/1970 | Marcouitch |
| 5,758,532 | 6/1998 | Massee |
| 5,901,595 | 5/1999 | Massee |
| 3,340,713 | 9/1967 | Webb |

FOREIGN PATENT DOCUMENTS

| | | |
|---|---|---|
| 3-146232 | 6/1991 | Japan |

Signed and Sealed this

Fourteenth Day of November, 2000

*Attest:*

Q. TODD DICKINSON

*Attesting Officer*

*Director of Patents and Trademarks*